US011092921B2

(12) United States Patent
Murakami

(10) Patent No.: US 11,092,921 B2
(45) Date of Patent: Aug. 17, 2021

(54) IMAGE FORMING APPARATUS AND METHOD OF SUPPLYING TONER TO PHOTOCONDUCTOR CLEANER

(71) Applicant: Konica Minolta, Inc., Tokyo (JP)

(72) Inventor: Yusuke Murakami, Okazaki (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/992,073

(22) Filed: Aug. 12, 2020

(65) Prior Publication Data

US 2021/0157261 A1 May 27, 2021

(30) Foreign Application Priority Data

Aug. 23, 2019 (JP) ..... JP2019-153135

(51) Int. Cl.
*G03G 15/00* (2006.01)
*G03G 21/00* (2006.01)

(52) U.S. Cl.
CPC ..... *G03G 15/5041* (2013.01); *G03G 21/0011* (2013.01)

(58) Field of Classification Search
CPC ..... G03G 15/5041; G03G 15/5058; G03G 21/0011
USPC ..... 399/49, 71, 72, 350
See application file for complete search history.

(56) References Cited

U.S. PATENT DOCUMENTS 8,103,206 B2 * 1/2012 Gross et al. ..... G03G 21/0011 399/346
10,782,640 B2 * 9/2020 Akashi et al. ..... G03G 15/5058
2020/0125011 A1 * 4/2020 Murakami ..... G03G 21/0011

FOREIGN PATENT DOCUMENTS

JP 2013-113879 A 6/2013

* cited by examiner

*Primary Examiner* — William J Royer
(74) *Attorney, Agent, or Firm* — Squire Patton Boggs (US) LLP

(57) ABSTRACT

An image forming apparatus includes: a photoconductor; a transfer portion; a photoconductor cleaner that removes residual toner from a surface of the photoconductor; and a first processor that forms a toner patch on the surface of the photoconductor. When the toner patch passes the transfer portion, the transfer portion makes the toner patch stay on the surface of the photoconductor such that toner of the toner patch is able to be supplied to the photoconductor cleaner. The first processor further determines an amount of toner for the toner patch with reference to a circumferential distance the photoconductor travels for a predetermined period of time.

24 Claims, 23 Drawing Sheets

Table determining a default amount of toner

| | Environment Step | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | ZU |
| K | 0.45 | 0.45 | 0.45 | 0.35 | 0.25 | 0.2 | 0.15 | 0.1 | 0.05 | 0.05 | 0.05 | 0.05 | 0.05 | 0.1 | 0.1 | 0.1 | mg |
| Y | 0.45 | 0.45 | 0.45 | 0.4 | 0.35 | 0.3 | 0.3 | 0.25 | 0.2 | 0.2 | 0.2 | 0.2 | 0.15 | 0.15 | 0.15 | 0.15 | mg |
| M | 0.45 | 0.45 | 0.45 | 0.4 | 0.35 | 0.3 | 0.3 | 0.25 | 0.2 | 0.2 | 0.2 | 0.15 | 0.1 | 0.05 | 0.05 | 0.05 | mg |
| C | 0.35 | 0.35 | 0.35 | 0.3 | 0.25 | 0.15 | 0.1 | 0.1 | 0.1 | 0.1 | 0.1 | 0.1 | 0.05 | 0.01 | 0.01 | 0.01 | mg |

FIG. 10

Table determining an upper limit on the amount of toner for one toner patch depending on the cleaning peformance of the photoconductor blade

| | Environment Step | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | ZU |
| 0～ | 0.85 | 0.85 | 0.85 | 0.85 | 0.85 | 0.85 | 0.65 | 0.65 | 0.65 | 0.65 | 0.55 | 0.55 | 0.55 | 0.55 | 0.45 | 0.45 | mg |
| 200krot～ | 0.75 | 0.75 | 0.75 | 0.75 | 0.75 | 0.75 | 0.55 | 0.55 | 0.55 | 0.55 | 0.45 | 0.45 | 0.45 | 0.45 | 0.35 | 0.35 | mg |
| 400krot～ | 0.65 | 0.65 | 0.65 | 0.65 | 0.65 | 0.55 | 0.45 | 0.45 | 0.45 | 0.35 | 0.35 | 0.35 | 0.35 | 0.35 | 0.35 | 0.25 | mg |
| 600krot～ | 0.65 | 0.55 | 0.55 | 0.55 | 0.55 | 0.55 | 0.35 | 0.35 | 0.35 | 0.25 | 0.25 | 0.25 | 0.25 | 0.25 | 0.25 | 0.2 | mg |

FIG. 11

Table determining a base pitch for single-sided printing

| | | Speed | | |
|---|---|---|---|---|
| | | 300mm/s | 200mm/s | 100mm/s |
| Paper Size | ~216mm | 270mm | 280mm | 285mm |
| | ~300mm | 350mm | 360mm | 365mm |
| | ~400mm | 460mm | 470mm | 475mm |
| | ~500mm | 570mm | 580mm | 585mm |
| | 500mm~ | 600mm | 610mm | 615mm |

FIG. 12

Table determining a one-cycle pitch for duplex printing

| | | Speed | | |
|---|---|---|---|---|
| | | 300mm/s | 200mm/s | 100mm/s |
| Paper Size | ~216mm | 550mm | 570mm | 575mm |
| | ~300mm | 650mm | 670mm | 675mm |
| | ~400mm | 750mm | 770mm | 775mm |
| | ~500mm | 850mm | 870mm | 875mm |
| | 500mm~ | 1000mm | 1020mm | 1025mm |

FIG. 14

Threshold on the remaining amount of toner for judging whether to perform PPM control

| | Environment Step | | | | | | | | | | | | | | | | |
|---|---|---|---|---|---|---|---|---|---|---|---|---|---|---|---|---|---|
| | 1 | 2 | 3 | 4 | 5 | 6 | 7 | 8 | 9 | 10 | 11 | 12 | 13 | 14 | 15 | 16 | |
| 0～ | 43 | 43 | 43 | 43 | 43 | 43 | 33 | 33 | 33 | 33 | 28 | 28 | 28 | 28 | 23 | 23 | mg |
| 200krot～ | 38 | 38 | 38 | 38 | 38 | 38 | 28 | 28 | 28 | 28 | 23 | 23 | 23 | 23 | 23 | 23 | mg |
| 400krot～ | 33 | 33 | 33 | 33 | 33 | 28 | 23 | 23 | 23 | 18 | 18 | 18 | 18 | 18 | 18 | 13 | mg |
| 600krot～ | 33 | 28 | 28 | 28 | 28 | 28 | 18 | 18 | 18 | 13 | 13 | 13 | 13 | 13 | 13 | 10 | mg |

FIG. 20

Table determining PPM

| | Remaining Amount of Toner | | | |
|---|---|---|---|---|
| | 40mg | 30mg | 20mg | 10mg |
| Productivity | 80% | 85% | 90% | 95% |

FIG. 21

IMAGE FORMING APPARATUS AND METHOD OF SUPPLYING TONER TO PHOTOCONDUCTOR CLEANER

The disclosure of Japanese Patent Application No. 2019-153135 filed on Aug. 23, 2019, including description, claims, drawings, and abstract, is incorporated herein by reference in its entirety.

TECHNOLOGICAL FIELD

The present invention relates to: a copier, a printer, a facsimile, or an image forming apparatus such as a multifunction peripheral (MFP) i.e. a multifunctional digital machine having multiple functions such as a copier, printer, and facsimile function; and a method of supplying toner to a photoconductor cleaner. Specifically, the image forming apparatus is an electrophotographic image forming apparatus.

DESCRIPTION OF THE RELATED ART

Electrophotographic image forming apparatuses develop a toner image by attracting toner onto a photoconductor, transfer the toner image onto a sheet of paper, and scrape residual toner off the surface of the photoconductor using a photoconductor blade of the photoconductor cleaner.

When the photoconductor blade has little toner on itself, it can lose performance on cleaning and can even be damaged, while causing image noise stretching in sub-scanning directions (FD noise).

To solve this problem, conventional image forming apparatuses supply toner as a lubricant to the photoconductor cleaner. Specifically, they form a toner patch after the last toner image or between two successive toner images on the photoconductor when having consecutively printed a predetermined number of pages with low toner coverages.

In recent years, more toner for image forming apparatuses has becoming titanium-less and small in particle size for eco-friendly products and better image quality. Titanium-less toner in small particle size causes less fogging and enhances the transfer efficiency, inevitably resulting in a constant lack of toner to the photoconductor cleaner. For that reason, there is a need for the image forming apparatuses to form a toner patch after every sheet of paper to supply sufficient toner to the photoconductor cleaner.

Since the photoconductor cleaner is located downstream of the toner transfer portion in a rotation direction of the photoconductor, operations must be controlled such that, after being formed on the photoconductor, a toner patch escapes being transferred onto the paper by the transfer portion and toner is thus supplied to the photoconductor cleaner successfully.

Japanese Unexamined Patent Application Publication No. 2013-113879 describes that: a length of a toner patch is calculated with reference to: (i) the distance between two successive sheets of paper, (ii) the time needed to turn on/off bias for first toner transfer, and (iii) the rotation speed of the photoconductor; and as a longer toner patch as possible in the space is formed.

Practically, an adequate amount of toner to the photoconductor blade is dependent on a circumferential distance the photoconductor travels from a leading-edge point for the n-th sheet of paper to the same of the (n+1)-th sheet of paper. According to Japanese Unexamined Patent Application Publication No. 2013-113879, however, an upper limit on the length of a toner band, allowed in the space between the n-th and (n+1)-th sheet of paper is calculated; and it may correspond to too much toner or too little toner to supply. Furthermore, when an event that extends the space between the n-th and (n+1)-th sheet of paper (e.g. a delay in image processing, sheet feeder change, cleaning, and temperature adjustment of the fuser) occurs, toner of an extra amount that corresponds to an extra circumferential distance the photoconductor needs to travel because of the event needs to be supplied. However, a waiting time caused by the event is not calculated in this technique; toner of the extra amount is not supplied accordingly.

SUMMARY

The present invention, which has been made in consideration of such a technical background as described above, relates to: an image forming apparatus that is capable of supplying toner of an adequate amount successfully to the photoconductor cleaner even when an event that extends the space between two successive sheets of paper occurs; and a method of supplying toner to the photoconductor cleaner.

A first aspect of the present invention relates to an image forming apparatus including:

a photoconductor;

a transfer portion;

a photoconductor cleaner that removes residual toner from a surface of the photoconductor; and a first processor that forms a toner patch on the surface of the photoconductor, wherein, when the toner patch passes the transfer portion, the transfer portion makes the toner patch stay on the surface of the photoconductor such that toner of the toner patch is able to be supplied to the photoconductor cleaner, the first processor further determining an amount of toner for the toner patch with reference to a circumferential distance the photoconductor travels for a predetermined period of time.

A second aspect of the present invention relates to a toner supply method for an image forming apparatus including:

a photoconductor;

a transfer portion; and a photoconductor cleaner that removes residual toner from a surface of the photoconductor, and the toner supply method allowing the image forming apparatus to supply toner to the photoconductor cleaner, the toner supply method including:

determining an amount of toner with reference to a circumferential distance the photoconductor travels for a predetermined period of time;

forming a toner patch of the amount of toner on the surface of the photoconductor; and when the toner patch passes the transfer portion, making the toner patch stay on the surface of the photoconductor such that toner of the amount is able to be supplied to the photoconductor cleaner.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 10 is a table, as an example, that determines a default amount of toner for a toner patch depending on the environment and toner color.

FIG. 11 is a table, as an example, that determines an upper limit on the amount of toner for a toner patch depending on the cleaning performance of the photoconductor blade. The cleaning performance of the photoconductor blade is represented by the environment and the cumulative circumferential distance of the photosensitive drum.

FIG. 12 is a table, as an example, that determines a default base pitch for single-sided printing.

FIG. 14 is a table, as an example, that determines a one-cycle pitch for duplex printing.

FIG. 20 is a table that determines a threshold on the remaining amount of toner for judging whether to perform PPM control, depending on the environment and the cumulative circumferential distance of the photosensitive drum.

FIG. 21 is a table, as an example, that determines productivity during PPM operation as a percentage depending on the remaining amount of toner.

DETAILED DESCRIPTION OF EMBODIMENTS

Hereinafter, one or more embodiments of the present invention will be described with reference to the drawings. However, the scope of the invention is not limited to the disclosed embodiments.

Figure 1:
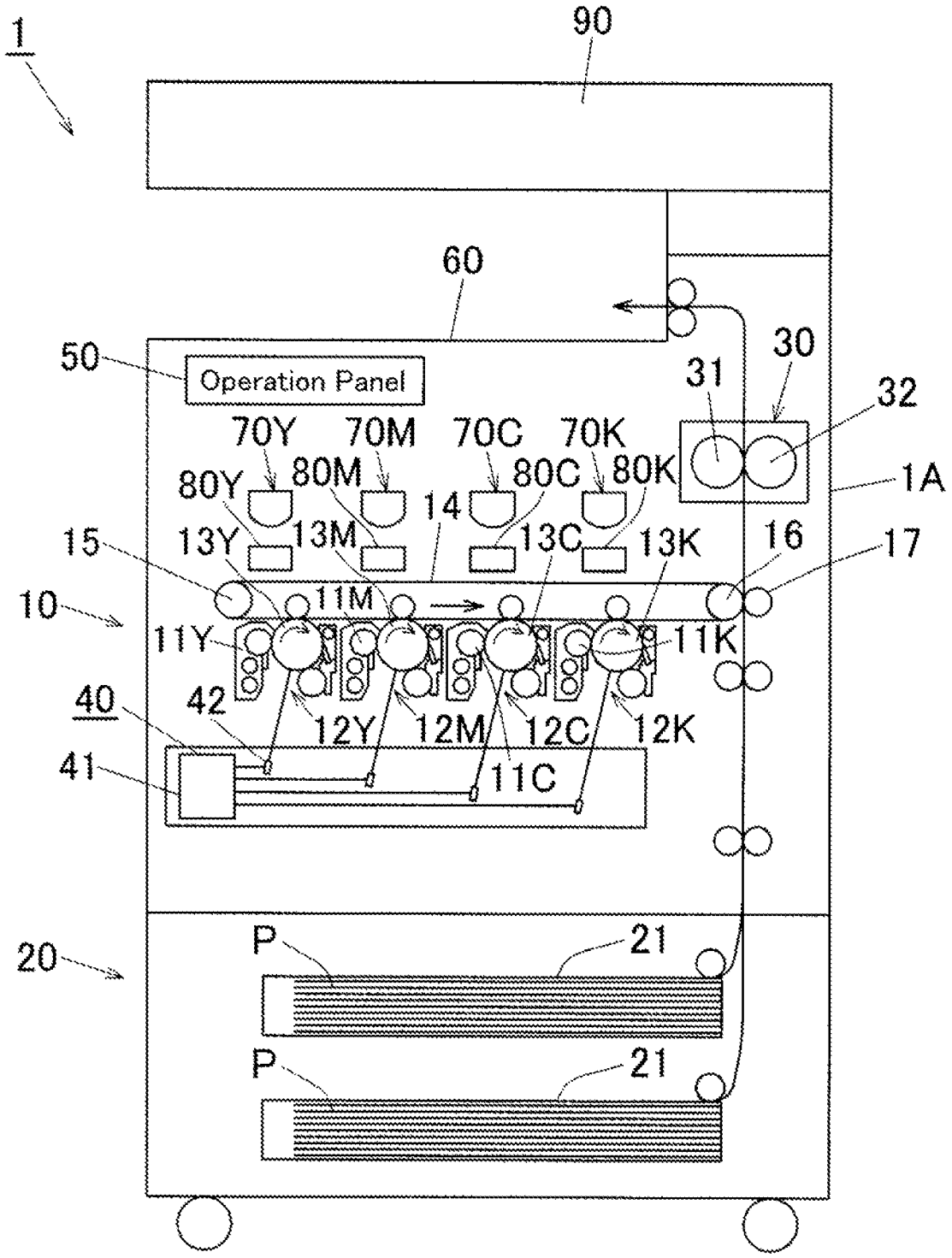
FIG. 1 is a schematic diagram illustrating a configuration of an image forming apparatus according to one embodiment of the present invention.

FIG. 1 is a schematic diagram illustrating a configuration of an image forming apparatus 1 according to one embodiment of the present invention. In this embodiment, an MFP i.e. a multifunctional digital machine as described above is employed as the image forming apparatus 1.

As referred to FIG. 1, the image forming apparatus 1 has a main body 1A; the main body 1A has a paper feeder 20 in its lower region, an imaging device 10 in its middle region, and an image reading device 90 and a paper output tray 60 in its upper region. The paper feeder 20 and the paper output tray 60 are connected by a paper conveyance path that conveys upward a sheet of paper P that is fed by the paper feeder 20.

The imaging device 10 is provided with: a driving roller 16 and a driven roller 15 as a pair; an intermediate transfer belt 14; and photoconductor units 12C, 12M, 12Y, and 12K constituting imaging units of cyan (C), magenta (M), yellow (Y), and black (K). The driving roller 16 and the driven roller 15 are positioned vertically about in the middle region of the main body 1A; the intermediate transfer belt 14 is looped over the driving roller 16 and the driven roller 15 in an elliptic form having two horizontal lines and run in a direction indicated by the arrow; the photoconductor units 12C, 12M, 12Y, and 12K are positioned along the intermediate transfer belt 14.

After forming toner images, the photoconductor units 12C, 12M, 12Y, and 12K transfer the toner images one by one onto the intermediate transfer belt 14. When a sheet of paper P reaches the driving roller 16 (on the right of the belt in this figure) along the paper conveyance path, the toner images on the intermediate transfer belt 14 are re-transferred onto the sheet of paper P by a second transfer roller 17 (corresponds to a transfer means). The sheet of paper P is then conveyed to a fusing unit 30 to have the toner images fused on the surface of itself.

In this embodiment, the fusing unit 30 is provided with: a heat roller 31 having a heater not shown in the figure; and a pressure roller 32 that is mounted such that it is in contact with the heat roller 31. While the sheet of paper P passes a nip region formed between the heat roller 31 and the pressure roller 32, the heat roller 31 and the pressure roller 32 apply heat and pressure to the sheet of paper P such that the toner images are fused on it.

The photoconductor units 12C, 12M, 12Y, and 12K conduct imaging by the method of electrostatic copying. The photoconductor units 12C, 12M, 12Y, and 12K are provided with: development portions 11C, 11M, 11Y, and 11K; and photosensitive drums 13C, 13M, 13Y, and 13K, respectively. Each photoconductor unit is further provided with an electrifier, a toner transfer portion, and the like. These components are mounted on the periphery of their corresponding photoconductor unit. The main body 1A is further provided with a luminous section 40; the luminous section 40 is essentially provided with: a print head 41 having four laser diodes, four polygon mirrors, and four scanning lenses; and four reflective mirrors 42. While the photosensitive drums 13C, 13M, 13Y, and 13K are charged by the electrifier, their corresponding laser diodes emit light to the surfaces of the photosensitive drums 13C, 13M, 13Y, and 13K to form latent images thereon.

The main body 1A is further provided with: toner cartridges 70C, 70M, 70Y, and 70K; and sub-hoppers 80C, 80M, 80Y, and 80K, which serve as a supply mechanism for supplying toner to the development portions 11C, 11M, 11Y, and 11K of the photoconductor units 12C, 12M, 12Y, and 12K. The toner cartridges 70C, 70M, 70Y, and 70K and the sub-hoppers 80C, 80M, 80Y, and 80K are positioned above the photoconductor units 12C, 12M, 12Y, and 12K.

As referred to FIG. 1, the main body 1A is further provided with an operation panel 50 having keys and a display.

The paper feeder 20 is provided with one or more paper cassettes 21 (two paper cassettes in FIG. 1 as an example). Upon the start of printing, the paper feeder 20 feeds a sheet of paper P from one of the paper cassettes 21. The sheet of paper P is then conveyed by one or more pairs of conveyance rollers mounted along the paper conveyance path, to the second transfer position to have toner images transferred by the second transfer roller 17. The image forming apparatus 1 may be further provided with a manual bypass tray.

Figure 2:
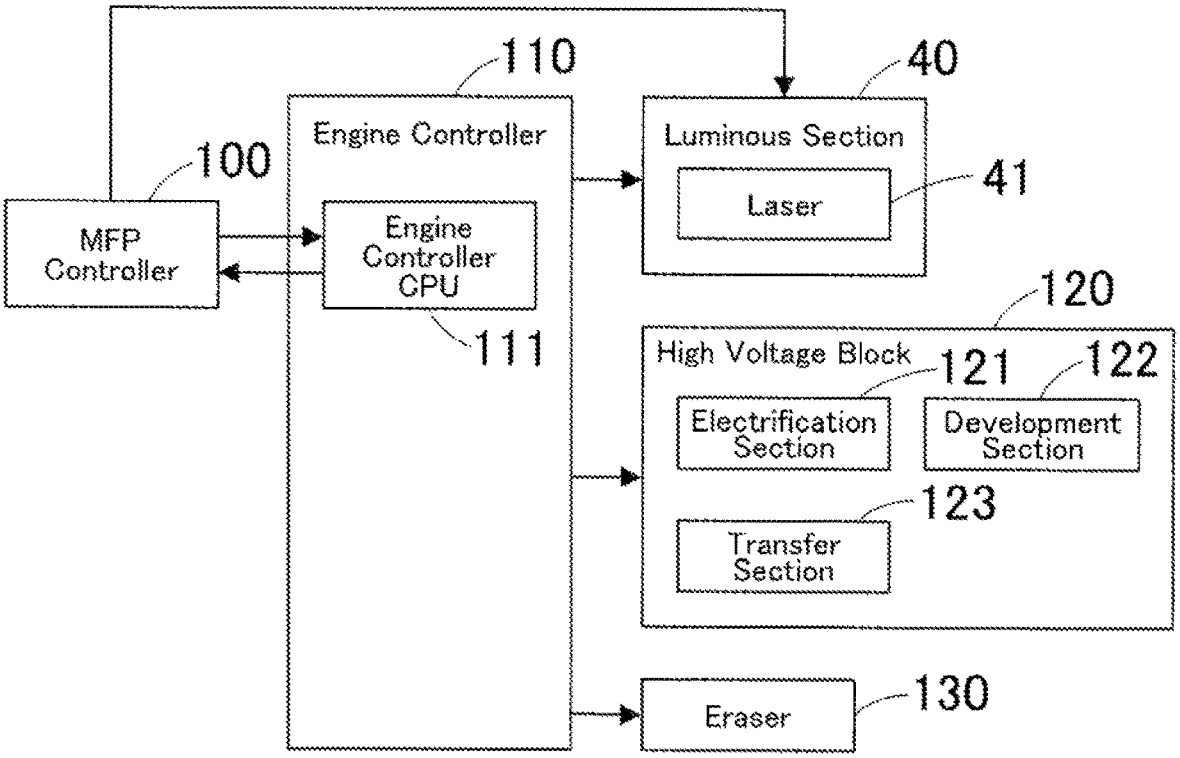
FIG. 2 is a block diagram illustrating an electrical configuration of print control machinery in an image forming apparatus.

FIG. 2 is a block diagram illustrating an electrical configuration of print control machinery in the image forming apparatus 1. As referred to FIG. 2, the image forming apparatus 1 is essentially provided with an MFP controller 100, an engine controller 110, the luminous section 40 described above, a high voltage block 120, and an eraser 130.

The MFP controller 100 controls the image forming apparatus 1 in a unified and systematic manner. In cooperation with the MFP controller 100, the engine controller 110 controls the luminous section 40, the high voltage block 120, and the eraser 130. The engine controller 110 is essentially provided with: an engine controller CPU 111 that performs control processes; a ROM that stores operation programs and the like for the engine controller CPU 111; and a RAM that serves as a workspace for the engine controller CPU 111. The ROM and the RAM are not shown in the figure.

As described above, while the photosensitive drums 13C, 13M, 13Y, and 13K are charged by the electrifier, the luminous section 40 emits light to the surfaces of the photosensitive drums 13C, 13M, 13Y, and 13K to form latent images thereon. The luminous section 40 is provided with a laser 41 that emits light to the photosensitive drums 13C, 13M, 13Y, and 13K.

The high voltage block 120 is a block that applies high voltage to the photosensitive drums 13C, 13M, 13Y, and 13K. The high voltage block 120 is provided with: an electrification section 121 including the electrifiers that charge the photosensitive drums 13C, 13M, 13Y, and 13K; a development section 122 including the development portions 11C, 11M, 11Y, and 11K that develop toner images from the latent images formed on the photosensitive drums 13C, 13M, 13Y, and 13K; and a transfer section 123 including the transfer portion that transfer, onto the intermediate transfer belt 14, the toner images developed on the photosensitive drums 13C, 13M, 13Y, and 13K. The engine controller 110 regulates the voltage to the electrification section 121, the development section 122, and the transfer section 123.

The eraser 130 removes static electricity from the surfaces of the photosensitive drums 13C, 13M, 13Y, and 13K.

The photosensitive drums 13C, 13M, 13Y, and 13K have in common: the laser 41 of the luminous section 40; the electrification section 121 of the high voltage block 120; the development section 122 of the high voltage block 120; and the transfer section 123 of the high voltage block 120; and the eraser 130.

Figure 3:
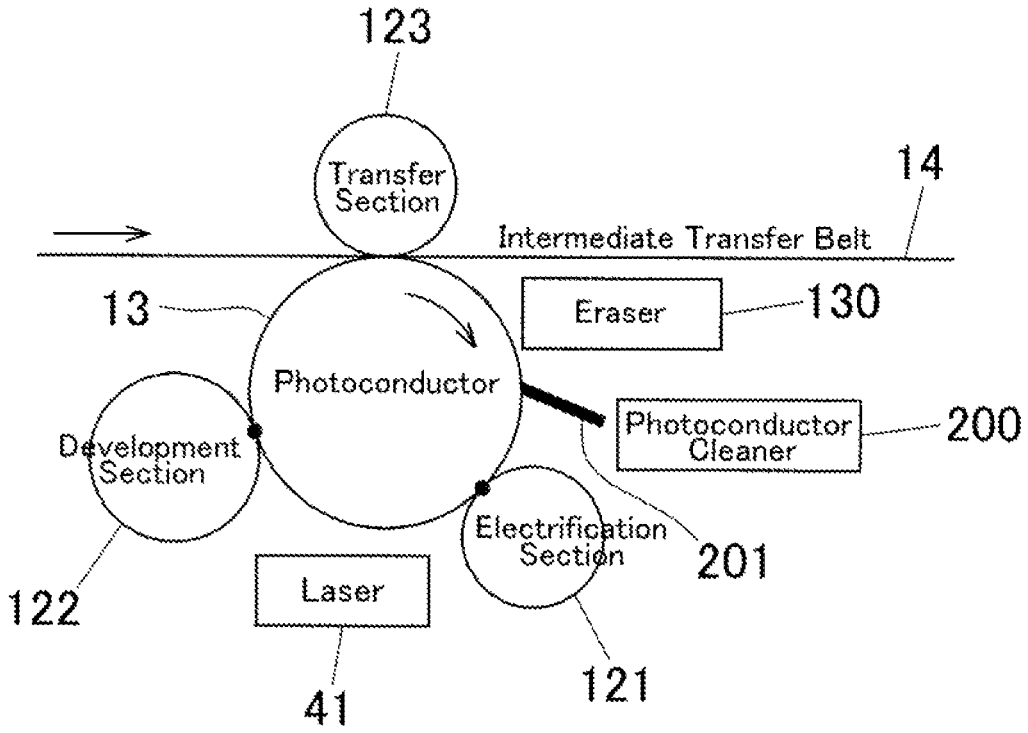
FIG. 3 is a schematic diagram focusing on a photosensitive drum and its peripheral parts.

FIG. 3 is a schematic diagram focusing on a photosensitive drum (photoconductor) 13 as the photosensitive drum 13C, 13M, 13Y, or 13K and its peripheral parts. Hereinafter, the photosensitive drums 13C, 13M, 13Y, and 13K each will be referred to as "photosensitive drum 13" unless it is necessary to make them distinguishable from one another. The photosensitive drums 13 have an identical configuration.

The photosensitive drum 13 rotates clockwise as pointed by the arrow. The photosensitive drum 13 is surrounded by the electrification section 121, the luminous section 40 including the laser 41, the development section 122, the transfer section 123, the eraser 130, and a photoconductor cleaner (hereinafter may be referred to as "cleaner" for short) 200, which are, in this order, mounted downstream in the rotation direction of the photosensitive drum 13. The transfer section 123 is mounted across the intermediate transfer belt 14 from the photosensitive drum 13.

The photoconductor cleaner 200 serves to remove residual toner from the surface of the photosensitive drum 13. The photoconductor cleaner 200 is provided with a photoconductor blade 201 that scrapes residual toner off the surface of the photosensitive drum 13. When the photoconductor blade 201 has little toner on itself, it can lose performance on cleaning and can even be damaged, causing image noise stretching in sub-scanning directions (FD noise).

To supply toner to the photoconductor blade 201, the image forming apparatus 1 forms a toner patch on the photosensitive drum 13 in the space between two successive sheets of paper during printing. Specifically, in this embodiment, operations are controlled such that an amount of toner is calculated with reference to the circumferential distance the photosensitive drum 13 has traveled for a predetermined period of time and such that a toner patch is formed from toner of the calculated amount and provided to the photoconductor blade 201. These operations will be further described below.

[How to Form Toner Patches]

Hereinafter, how to form a toner patch on the photosensitive drum 13 in the space between two successive toner images to be transferred onto sheets of paper will be described.

Figure 4:
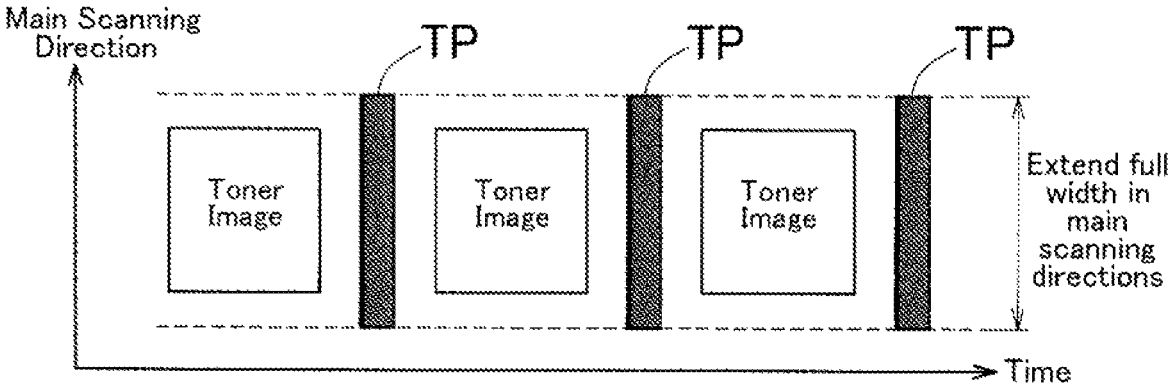
FIG. 4 is a conceptual diagram of toner patches.

FIG. 4 is a conceptual diagram of toner patches; the vertical axis represents a main scanning direction and the horizontal axis represents time. Toner images to be transferred onto sheets of paper are formed on the surface of the photosensitive drum 13 one by one at predetermined intervals; a toner patch TP is formed in the space between two successive toner images, in other words, in the space between two successive sheets of paper. The toner patches TP extend full width in main scanning directions.

Figure 5:
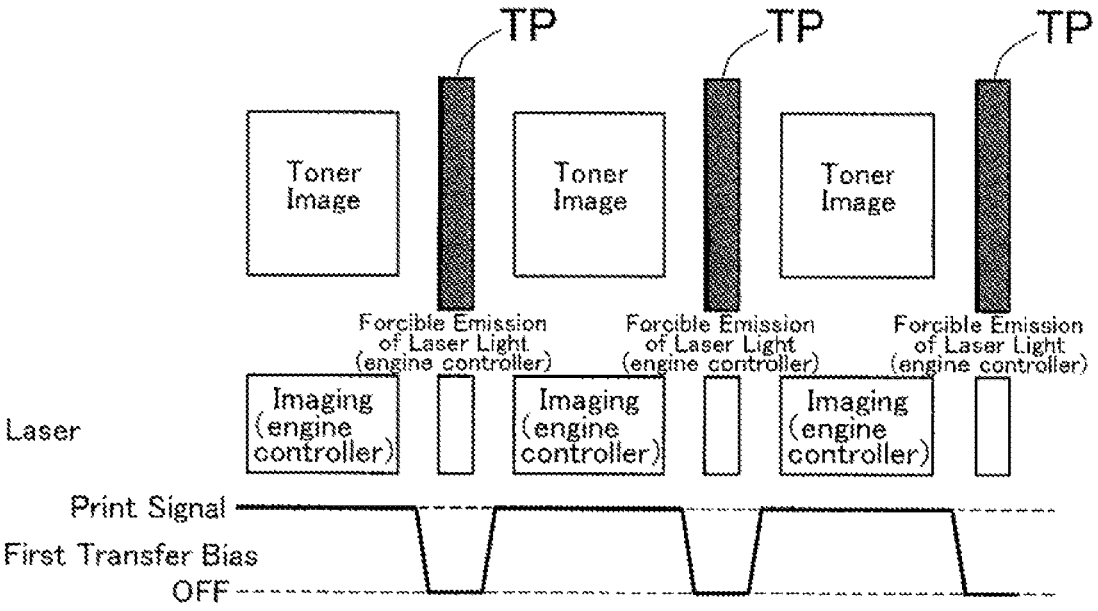
FIG. 5 is a timing diagram for reference in describing that toner patches are formed with laser light.

Toner patches TP are formed on the surface of the photosensitive drum 13 with laser light emitted by the laser 41, for example. FIG. 5 is a timing diagram for reference in describing this example.

To form toner images at right positions in the space between two successive sheets of paper, the laser 41 makes a forced emission of laser light as commanded by the engine controller 110. The laser 41 may emit laser light in accordance with image information from the MFP controller 100.

When the transfer section 123 receives a toner image region, the first transfer bias is shifted to print signal.

Receiving print signal, the transfer section 123 transfers the toner image onto the intermediate transfer belt 14 as a first transfer process. When the transfer section 123 receives a toner patch region, the first transfer bias is shifted to patch signal that allows a toner patch TP in the region to escape being transferred onto the intermediate transfer belt 14. In the example of FIG. 5, patch signal is OFF (power-down); alternatively, patch signal may be lower than print signal as an absolute value or may be the same level as the bias for toner. Now the first transfer bias is patch signal, and the toner patch TP is not transferred onto the intermediate transfer belt 14 when passing the transfer section 123. The toner patch TP is thus successfully conveyed to the photoconductor blade 201 of the photoconductor cleaner 200.

Figure 6:
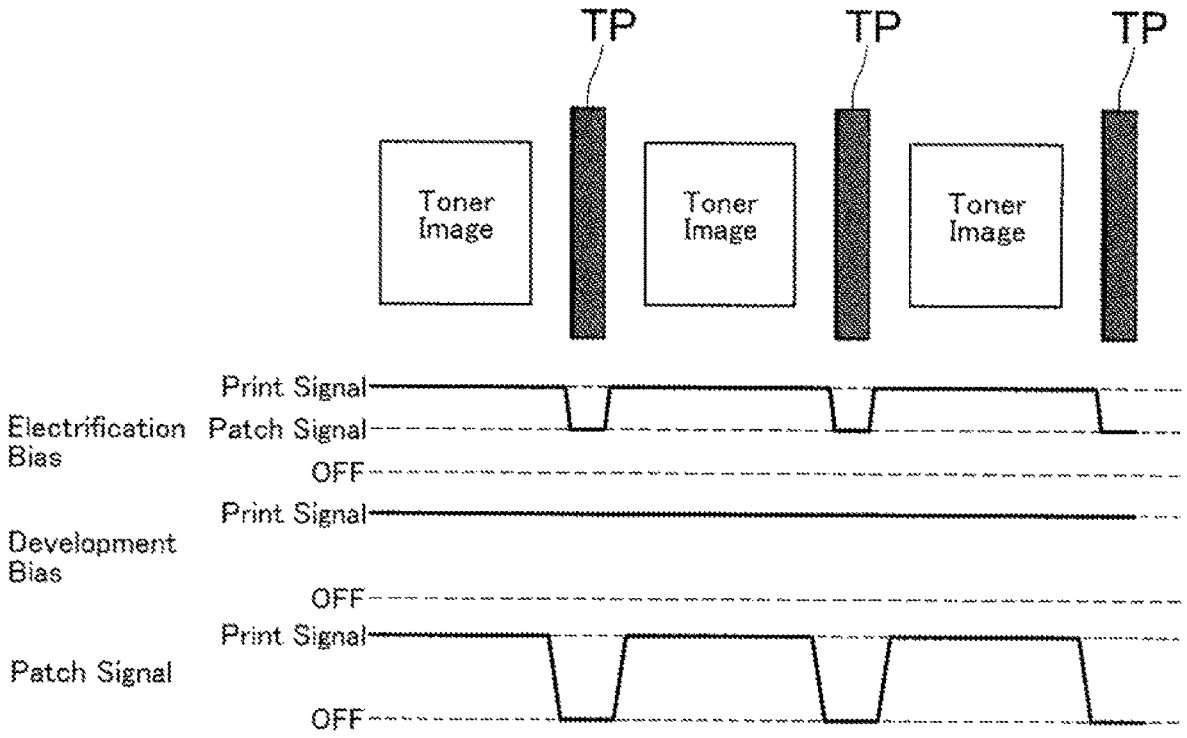
FIG. 6 is a timing diagram for reference in describing that toner patches are formed by changing the noise margin (fogging margin).

Toner patches TP are formed on the surface of the photosensitive drum 13 by changing the fogging margin. FIG. 6 is a timing diagram for reference in describing this example.

Changing the fogging margin is shifting development bias of the development section 122 or electrification bias of the electrification section 121. In the example of FIG. 6, when the electrification section 121 receives a toner patch region, the electrification bias is shifted from print signal to patch signal, causing a difference between the development bias and the electrification bias. With this difference, a toner patch TP is formed in the region. Similar to the example of FIG. 5, when the transfer section 123 receives a toner patch region, the first transfer bias is shifted to patch signal that allows a toner patch TP in the region to escape being transferred onto the intermediate transfer belt 14. So, the toner patch TP is not transferred onto the intermediate transfer belt 14 when passing the transfer section 123. The toner patch TP is thus successfully conveyed to the photoconductor blade 201 of the photoconductor cleaner 200.

Figure 7:
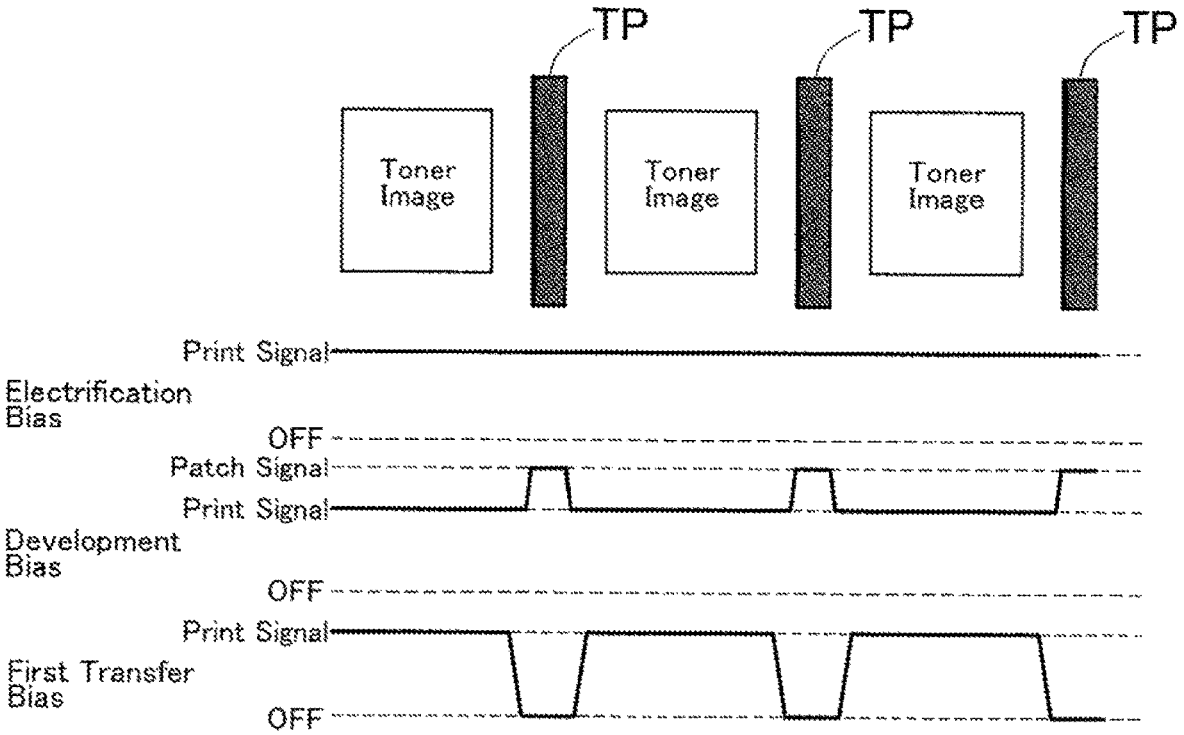
FIG. 7 is a timing diagram for reference in describing that toner patches are formed by changing the fogging margin; a toner patch is formed in the space between two successive toner images by shifting a development bias from print signal to patch signal.

FIG. 7 is a timing diagram for reference in describing that toner patches are formed by changing the fogging margin; a toner patch is formed in the space between two successive toner images by shifting the development bias from print signals to patch signals. Similar to the example of FIG. 5, when the transfer section 123 receives a toner patch region, the first transfer bias is shifted to patch signal such that a toner patch TP in the region escapes being transferred onto the intermediate transfer belt 14.

Figure 8:
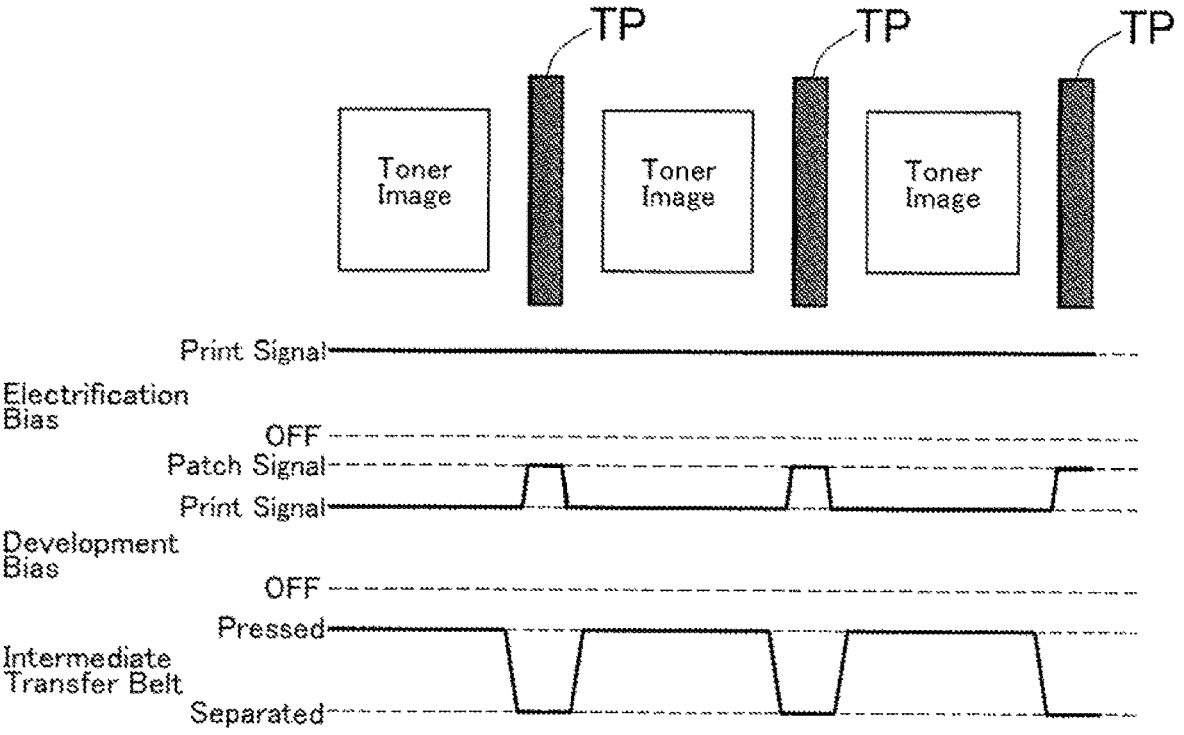
FIG. 8 is a timing diagram for reference in describing that an intermediate transfer belt is separated from the photosensitive drum to escape having toner patches thereon.

FIG. 8 is a timing diagram for reference in describing the case in which the intermediate transfer belt 14 is capable of being separated from the photosensitive drum 13. The first transfer bias is not shifted in this case; instead, the intermediate transfer belt 14 is separated from the photosensitive drum 13 to escape having a toner patch TP thereon.

When the transfer section 123 receives a toner image region, the intermediate transfer belt 14 is pressed onto the photosensitive drum 13 to have a toner image thereon. In contrast, when the transfer section 123 receives a toner patch region, the intermediate transfer belt 14 is separated from the photosensitive drum 13 to escape having a toner patch TP thereon. So, the toner patch TP is not transferred onto the intermediate transfer belt 14 when passing the transfer section 123. The toner patch TP is thus successfully conveyed to the photoconductor blade 201 of the photoconductor cleaner 200. In FIG. 8, toner patches are formed by changing the fogging margin.

[How to Determine an Amount of Toner for a Toner Patch]

Figure 9:
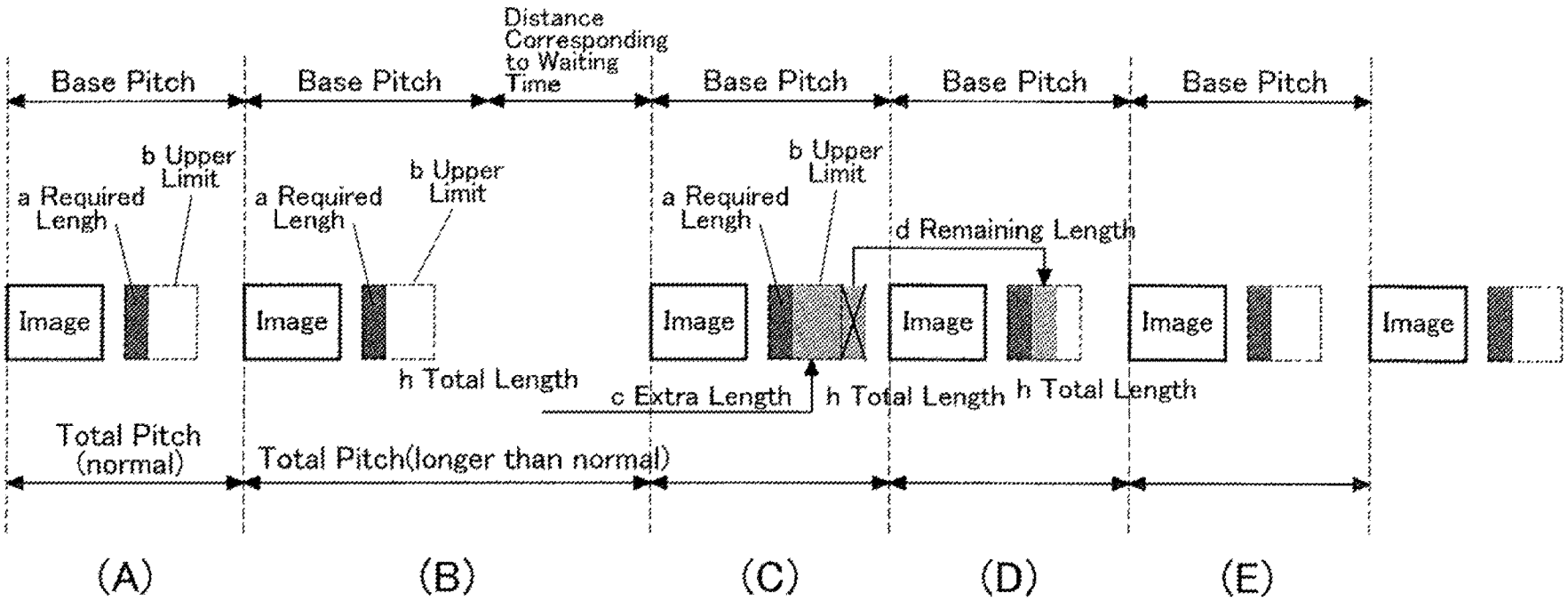
FIG. 9 is a timing diagram illustrating toner images formed on the surface of the photosensitive drum in sequence.

Hereinafter, how to determine an amount of toner for a toner patch to be formed in the space between two successive toner images will be described with reference to FIG. 9. FIG. 9 is a timing diagram illustrating toner images (referred to "images" for short in the figure) formed on the surface of the photosensitive drum 13 in sequence. The toner images will be transferred onto the intermediate transfer belt 14 then re-transferred onto sheets of paper.

Normally, the space between two successive toner images (two successive sheets of paper) is just like in the pitch (A); in this case, the total pitch is substantially equal to the base pitch. Normally, every space between two successive toner images has the base pitch. Abase pitch is calculated in a base pitch calculation process by the engine controller 110.

When a delay in imaging, fusing, conveyance, or image processing, for example, occurs and a waiting time is caused thereby, the total pitch is longer than the base pitch just like the pitch (B); specifically, it is the sum of the base pitch and an extra distance corresponding to the waiting time.

A toner patch is formed after every toner image. In the following description, for the sake of convenience, a toner patch is defined by the length, which is the sub-scanning length. A toner patch also can be defined by the amount of toner (obtained by multiplying the length by the toner density) but can never be defined by an upper limit on the length.

[1] Required Length (Referred to as "Length" for Short in the Figure) a

A required length a of a toner patch to be formed after the n-th sheet of paper is calculated with reference to the base pitch from the n-th sheet of paper to the (n+1)-th sheets of paper. For example, a required length a is calculated with reference to a default length and a default pitch for the specified paper (A4-size in landscape orientation, for example). A required length a is calculated from Required Length a=Default Length×Base Pitch÷Default Pitch for Specified Paper Alternatively, a required length a may be calculated with reference to a default length and a default distance (1 mm, for example). In this case, a required length a can be calculated from Required Length a=Default Length×Base Pitch÷Default Distance

[2] Upper Limit on Allowed Length (Referred to as "Upper Limit" for Short in the Figure) b An upper limit on the allowed length of a toner patch to be formed after the n-th sheet of paper is calculated with reference to the base pitch from the n-th sheet of paper to the (n+1)-th sheet of paper. An upper limit b is calculated with reference to: (i) the FD length i.e. the sub-scanning length of the specified paper; (ii) the response time of the high voltage (HV) block for shifting the first transfer bias, the development bias, and the rectification bias; and (iii) the rotation speed of the photoconductor. An upper limit b is calculated from Distance between Two Successive Sheets of Paper=Base Pitch−FD Length of Specified Paper and Upper Limit b=Distance between Two Successive Sheets of Paper−(Response Time of HV Block× Rotation Speed of Photoconductor)

[3] Extra Length c

When the total pitch between two successive toner images is longer than the base pitch just like the pitch (B), it means the photosensitive drum 13 needs to travel a longer circumferential distance. In this embodiment, when the photosensitive drum 13 needs to travel a longer circumferential distance, toner of the corresponding amount will be supplied. Specifically, an extra length c will be added to a toner patch to be formed in the pitch (C), the next pitch.

The difference between the cumulative circumferential distances the photoconductor has ever traveled before the pitch (B) and before the pitch (C) is calculated. A total length of a toner patch supposed to be needed in the pitch (B) is calculated from the following equation. The circumferential distance of the photosensitive drum 13 is a distance the photosensitive drum 13 travels from a base point for the last sheet of paper to a base point for the present sheet of paper by rotating. The base point for a sheet of paper is a leading-edge point for the sheet of paper, a trailing-edge point for the sheet of paper, a leading edge of a toner patch, or a trailing edge of a toner patch. The cumulative circumferential distance of the photoconductor is a cumulative value of the distance the photosensitive drum 13 has ever traveled by rotating.

Total Length Supposed to Be Required=Default Length×Difference between Cumulative Circumferential Distances of Photoconductor+Default Distance In the equation above, the default distance may be replaced with the default pitch for the specified paper, as in the case of the required length a. An extra length c is calculated from Extra Length c=Total Length Supposed to Be Required−Actual Length

[4] Total Length h

As referred to FIG. 9, a toner patch having the sum of the required length a and the extra length c is formed in the pitch (C). The sum of the required length a and the extra length c may be greater than the upper limit b. The difference between the upper limit b and the sum of the required length a and the extra length c will be added to a toner patch to be formed in the pitch (D), the next pitch, as a remaining length d.

A total length h is calculated with reference to the required length a, the upper limit b, the extra length c, and the remaining length d.

(i) The case with the following condition will be described:

Upper Limit b Required Length a+Extra Length c+Remaining Length d

The upper limit on the amount of toner for one toner patch, which is a variable depending on the cleaning performance of the photoconductor blade 201, is represented by Lpmax. If Lpmax Required Length a+Extra Length c+Remaining Length d, then Total Length h=Required Length a+Extra Length c+Remaining Length d so, the remaining length d is set to zero.

If Lpmax<Required Length a+Extra Length c+Remaining Length d, then

Total Length h=Lpmax and the remaining length d is set to a value obtained from

Remaining Length d=Required Length a+Extra Length c+Remaining Length d−Lpmax (ii) The case with the following condition will be described:

Upper Limit b Required Length a+Extra Length c+Remaining Length d

If Lpmax Upper Limit b, then

Total Length h=Upper Limit b and the remaining length d is set to a value obtained from Remaining Length d=(Required Length a+Extra Length c+Remaining Length d)−Upper Limit b If Lpmax<Upper Limit b, then Total Length h=Lpmax and the remaining length d is set to a value obtained from Remaining Length d=Required Length a+Extra Length c+Remaining Length d−Lpmax The remaining length d obtained by any of the equations above is stored on a non-volatile memory. The remaining length d is preserved in the absence of power supply such that it is able to be added to a toner patch to be formed in the next pitch when power comes back on.

After the remaining length d is stored on the memory as described above, a paper jam or another error may occur to interrupt the formation of a toner patch. In this case, the remaining length d is corrected by adding the total length h to the remaining length d such that it is able to be added to a toner patch to be formed in the next pitch when the status returns to normal operation.

Hereinafter, how to determine a default amount of toner for a toner patch will be described.

The default amount of toner for a toner patch is a variable dependent on at least one of the environment, the cumulative circumferential distance of the photosensitive drum 13, and toner color. For example, in an environment where image noise stretching in sub-scanning directions (FD noise) can often occur, more toner needs to be supplied.

FIG. 10 is a table, as an example, that determines a default amount of toner for a toner patch depending on the environment and toner color. As referred to FIG. 10, the environment is evaluated by a combination of the temperature and the humidity; a greater environment step number represents a higher temperature with a higher humidity, and a less environment step number represents a lower temperature with a lower humidity. The same is true for the tables in FIGS. 11 and 20.

In the example of FIG. 10, for the same toner color, the default amount of toner becomes less with a greater environment step number. A default amount of toner retrieved from this table is converted to a default length of a toner patch, from which a required length a can be calculated. The default amount of toner may be a constant, not dependent on the environment, the cumulative circumferential distance of the photosensitive drum 13, or toner color.

Hereinafter, the upper limit on the amount of toner for one toner patch (Lpmax), which is a variable dependent on the cleaning performance of the photoconductor blade 201, will be described.

Specifically, the upper limit on the amount of toner for one toner patch is a variable dependent on at least one of the environment, the cumulative circumferential distance of the photosensitive drum 13, toner color, and the toner coverage of the last printed page. For example, when the photoconductor blade 201 becomes degraded in cleaning performance, the upper limit on the amount of toner needs to be less.

FIG. 11 is a table, as an example, that determines an upper limit on the amount of toner for one toner patch depending on the environment and the cumulative circumferential distance of the photosensitive drum 13. The cleaning performance of the photoconductor blade 201 is represented by the cumulative circumferential distance of the photosensitive drum 13. In the example of FIG. 11, for the same cumulative circumferential distance of the photosensitive drum 13, the upper limit of the amount of toner for one toner patch becomes less with a greater environment step number; for the same environment step number, the upper limit on the amount of toner for one toner patch becomes less with a longer cumulative circumferential distance of the photosensitive drum 13. Alternatively, the upper limit on the amount of toner for one toner patch may be a constant, not dependent on the environment, the cumulative circumferential distance of the photosensitive drum 13, toner color, or the toner coverage of the last printed page.

Hereinafter, how to convert the amount of toner to the length and the toner density will be described.

The length and toner density that satisfy the following equation is found.

$$\text{Amount of Toner[g]}=\text{Length[mm]}\times\text{Density[g/mm}^2\text{]}$$

The toner density may be a constant; in this case, only the length that satisfies the equation is found. Alternatively, the length may be a constant; in this case, only the toner density that satisfies the equation is found.

Hereinafter, a base pitch calculation process will be described.

A base pitch for single-sided printing, a base pitch for finishing (FNS), and a base pitch for duplex printing are calculated, and the largest one of them is used as the base pitch.

[1] Base Pitch for Single-Sided Printing

The default base pitch for single-sided printing is a variable dependent on a print setting (e.g. color mode, FD length of paper, speed, and sheet feeder), and a base pitch for single-sided printing is calculated with reference to the default base pitch and PPM.

$$\text{Base Pitch for Single-sided Printing}=\text{Default Base Pitch for Single-sided Printing}\div\text{PPM}$$

PPM control refers to a modulation scheme that briefly decreases the productivity by a certain percentage for fusing or a toner-related process; PPM is expressed as a percentage of the productivity. FIG. 12 is a table, as an example, that determines a default base pitch for single-sided printing. In the example of FIG. 12, for the same FD length, the default base pitch for single-sided printing becomes longer with a lower speed; for the same speed, the default base pitch for single-sided printing becomes longer with a longer FD length.

[2] Base Pitch for Finishing (FNS)

Figure 13:
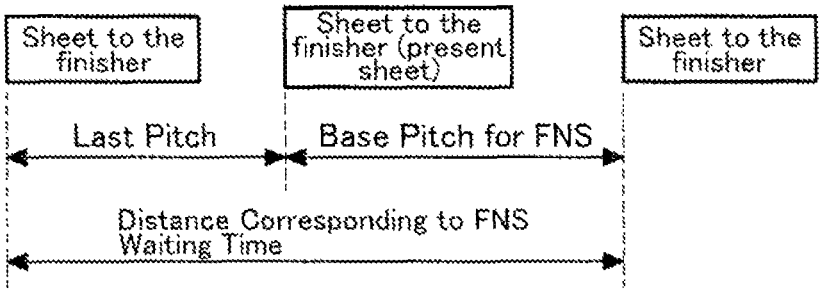
FIG. 13 is a diagram for reference in describing a base pitch for finishing (FNS).

As referred to FIG. 13, when the (n+1)-th sheet of paper is going to be conveyed to the finisher for a post-processing, a base pitch for finishing is calculated from the following equation. When the (n+1)-th sheet of paper is not going to be conveyed to the finisher, the base pitch for finishing is set to zero.

$$\text{Base Pitch for FNS}=\text{Distance Corresponding to FNS Waiting Time}-\text{Last Pitch}$$

The last pitch is a pitch from the (n−1)-th sheet of paper to the n-th sheet of paper. The FNS waiting time can be estimated with reference to the time needed to complete a post-processing. The post-processing is stapling, punching, folding, or saddle-stitching, for example.

[3] Base Pitch for Duplex Printing

When the next sheet of paper corresponds to a back side of a sheet of paper, a base pitch for duplex printing is obtained by subtracting the sum of the previous pitches before the present sheet of paper, from a one-cycle pitch for duplex printing, which starts with a sheet of paper corresponding to a front side of the same sheet of paper. When the next sheet of paper does not correspond to a back side of a sheet of paper, the base pitch for duplex printing is set to zero.

The one-cycle pitch for duplex printing is a variable dependent on a print setting (e.g. color mode, FD length of paper, speed, sheet feeder, and number of sheets of paper handled in one cycle). FIG. 14 is a table, as an example, that determines a one-cycle pitch for duplex printing.

Figure 15A:
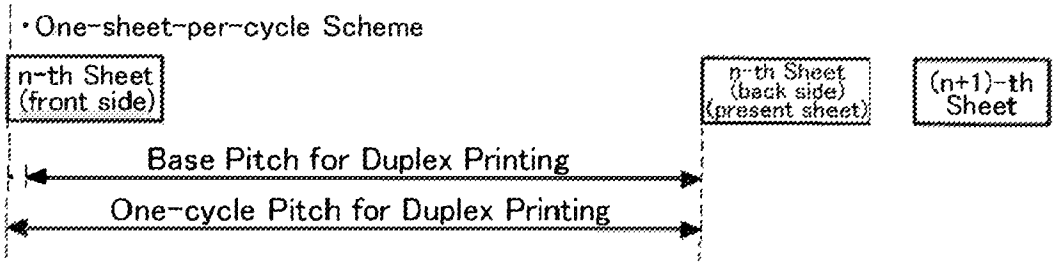
FIGS. 15A, 15B, and 15C are diagrams for reference in describing a base pitch for duplex printing.

FIG. 15A illustrates a one-sheet-per-cycle scheme, in which a first and back side of the n-th sheet of paper are printed successively. In this scheme, a base pitch for duplex printing is equal to the one-cycle pitch for duplex printing.

Figure 15B:
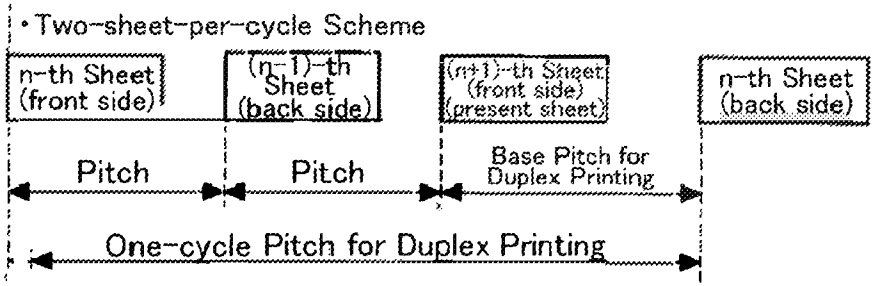

FIG. 15B illustrates a two-sheet-per-cycle scheme, in which a front side of an n-th sheet of paper, a back side of an (n−1)-th sheet of paper, a front side of an (n+1)-th sheet of paper (corresponds to the present sheet of paper), and a back side of the n-th sheet of paper, in this order, are printed successively. In this scheme, a base pitch for duplex printing is obtained by subtracting the sum of the two previous pitches from the one-cycle pitch for duplex printing.

Figure 15C:
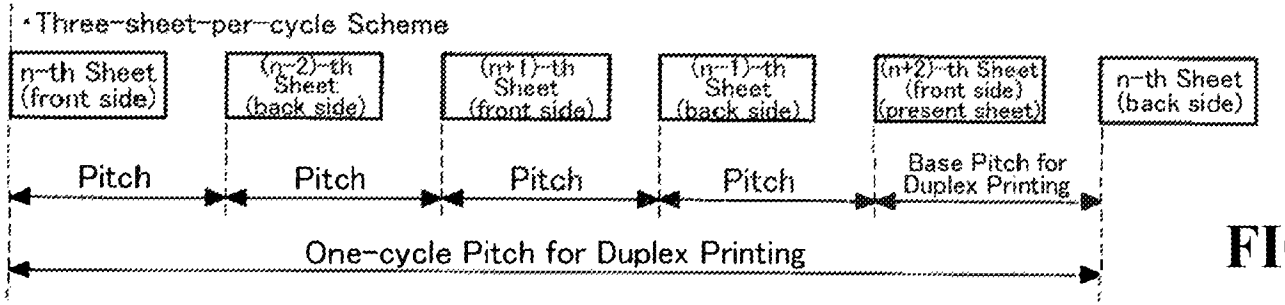

FIG. 15C illustrates a three-sheet-per-cycle scheme, in which a front side of an n-th sheet of paper, a back side of an (n−2)-th sheet of paper, a front side of an (n+1)-th sheet of paper, a back side of an (n−1)-th sheet of paper, a front side of an (n+2)-th sheet of paper (corresponds to the present sheet of paper), and a back side of the n-th sheet of paper, in this order, are printed successively. In this scheme, a base pitch for duplex printing is obtained by subtracting the sum of the four previous pitches from the one-cycle pitch for duplex printing.

When a negative value is obtained (in the "three-sheet-per-cycle" scheme), the base pitch for duplex printing is set to zero.

As described above, in this embodiment, an amount of toner for a toner patch is calculated with reference to the circumferential distance the photosensitive drum 13 has traveled for a predetermined period of time. When an event occurs and a waiting time is caused thereby, the space between two excessive sheets of paper is extended accordingly; and a toner patch is formed from toner of an amount corresponding to the circumferential distance of the photosensitive drum 13. Toner of a required amount is thus supplied to the photoconductor blade 201 of the photoconductor cleaner 200.

After a required amount of toner is calculated with reference to the pitch from an (n−1)-th sheet of paper to an n-th sheet of paper, a toner patch of the required amount of toner may not be afforded by the space between the (n−1)-th and n-th sheet of paper. In this case, the required amount calculated with reference to the pitch from the n-th sheet of paper to an (n+1)-th sheet of paper is corrected by adding the remaining amount and/or extra amount to the required amount. So, the amount of toner supplied to the photoconductor blade 201 of the photoconductor cleaner 200 is kept up to a sufficient degree while sheets of paper are consecutively printed.

[How to Determine an Amount of Toner for a Toner Patch when an Event from which a Waiting Time can be Estimated Occurs]

When an event from which a waiting time can be estimated occurs, an extra circumferential distance of the photoconductor can be estimated from the waiting time. An extra amount of toner, corresponding to the extra circumferential distance of the photoconductor is added to a toner patch to be formed. The event from which a waiting time can be estimated is color mode changing, paper feeder changing, cleaning of the second transfer portion, or pressing and releasing of the fuser, for example. When a waiting time cannot be estimated accurately, an extra amount of toner is calculated with reference to the least waiting time that can be estimated.

Figure 16:
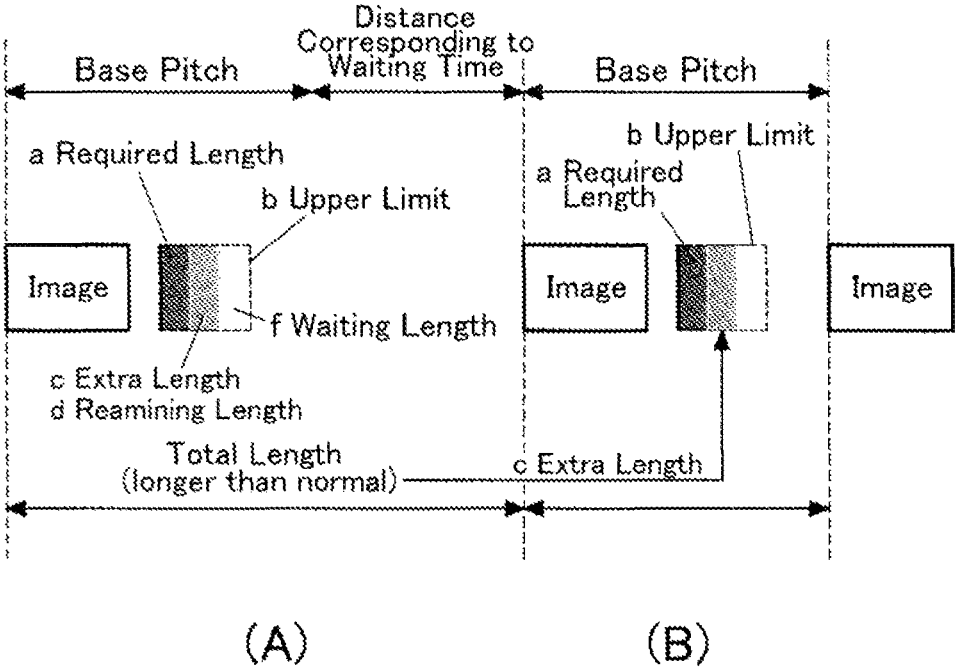
FIG. 16 is a timing diagram for reference in describing how to determine an amount of toner for a toner patch when an event from which a waiting time can be estimated occurs.

As referred to FIG. 16, a toner patch formed in the pitch (A) is defined by the sum of the required length a for the base pitch, the extra length c corresponding to a waiting time in the last pitch, the remaining length d that is carried over from the last pitch, and a waiting length f corresponding to an estimated waiting time. The following equation is used:

Total Length=Required Length a+Extra Length c+Remaining Length d+Waiting Length f A waiting length f corresponds to an extra amount of toner corresponding to an extra circumferential distance the photosensitive drum 13 needs to travel because of the waiting time. A waiting length f is calculated from Waiting Length f=Default Length×Extra Base Pitch Corresponding to Waiting Time÷Default Pitch for Specified Paper; or Waiting Length f=Default Length×Extra Base Pitch Corresponding to Waiting Time÷Default Distance When the waiting time is longer than estimated as in the case of the pitch (A) of FIG. 16, the difference between the cumulative circumferential distances the photoconductor has ever traveled before the pitch (A) and before the pitch (B) is calculated. The extra length c, corresponding to the difference will be added to a toner patch to be formed in the pitch (B).

As described above, when an event from which a waiting time can be estimated occurs, a waiting length f is obtained from an extra amount of toner, corresponding to an extra circumferential distance. Toner of a required amount is thus supplied to the photoconductor blade 201 of the photoconductor cleaner 200.

[How to Determine an Amount of Toner for a Toner Patch When an Event from which a Waiting Time cannot be Estimated Occurs]

Figure 17:
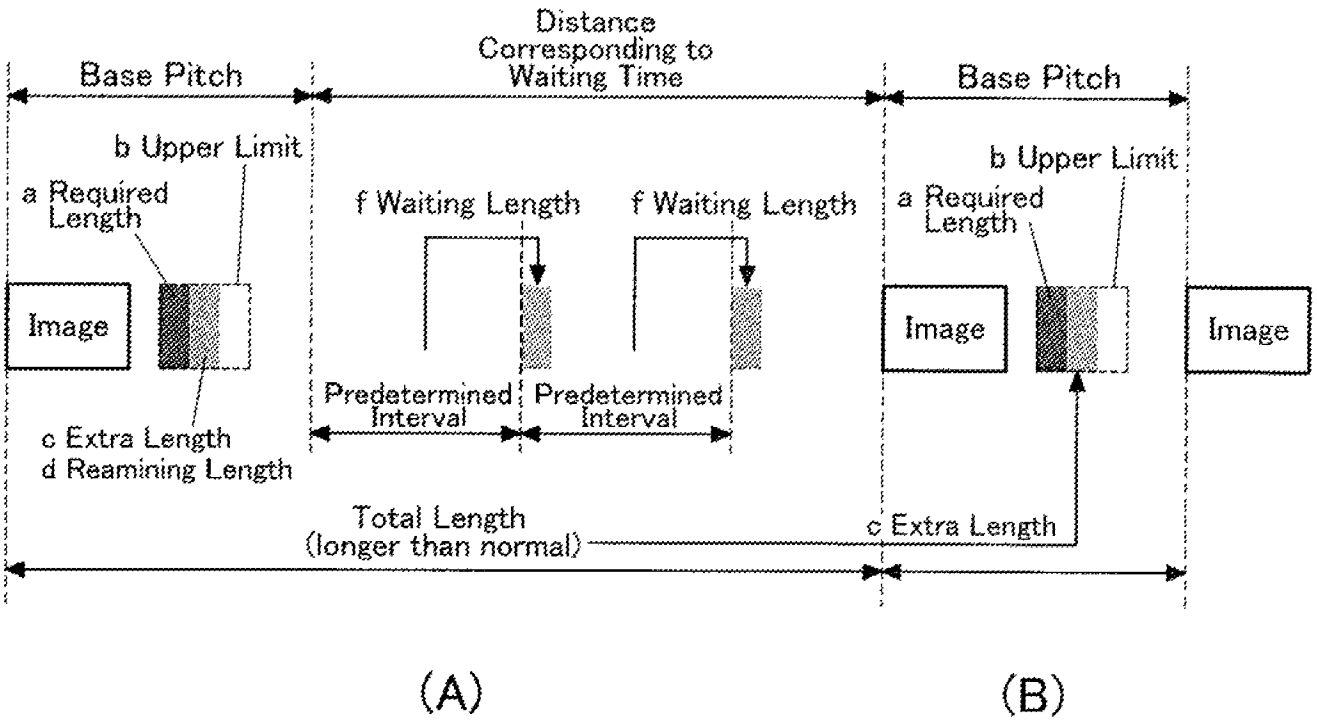
FIG. 17 is a timing diagram for reference in describing how to determine an amount of toner for a toner patch when an event from which a waiting time cannot be estimated occurs.

When an event from which a waiting time cannot be estimated occurs as in the case of the pitch (A), as illustrated in FIG. 17, a toner patch of a waiting length f is formed at predetermined intervals. The waiting length f corresponds to a circumferential distance the photoconductor travels for every predetermined period of time. The event from which a waiting time cannot be estimated is imaging, for example.

The waiting length f is calculated from

Waiting Length f=Default Length×Extra Base Pitch Corresponding to Waiting Time÷Default Pitch for Specified Paper; or Waiting Length f=Default Length×Extra Base Pitch Corresponding to Waiting Time÷Default Distance The difference between the cumulative circumferential distances the photosensitive drum 13 has ever traveled before the pitch (A) and before the pitch (B) is calculated, and the total length of a toner patch supposed to be needed in the pitch (A) is calculated from the difference. Subsequently, an extra length c is calculated by subtracting the total length of the toner patch formed in the pitch (A) from the total length of a toner patch supposed to be needed in the pitch (A). The extra length c will be added to a toner patch to be formed in the pitch (B), as illustrated in FIG. 17.

As described above, when an event from which a waiting time cannot be estimated occurs, a toner patch is formed at predetermined intervals. Toner of a required amount is thus supplied to the photoconductor blade 201 of the photoconductor cleaner 200.

[How to Form a Toner Patch After Printing]

The imaging device starts a power-down process upon the completion of a print job. When the imaging device is going to start a power-down process and the remaining length stored on the memory is not zero, a toner patch of the remaining length is formed after the last toner image. The completion of a print job is judged when the last toner image has passed the second transfer roller 17 and the photosensitive drum 13 does not carry any toner image. In other words, the imaging device starts a power-down process when there is no print job in the queue and when the speeds or resolutions for two successive sheets of paper are different.

When there is no print job in the queue, it means there is no fixed information and a toner image for the next print job will not be formed so soon. In contrast, when there is a print job in the queue, it means the speeds or resolutions for two successive sheets of paper are different and a toner image for the next print job will be formed soon.

Figure 18:
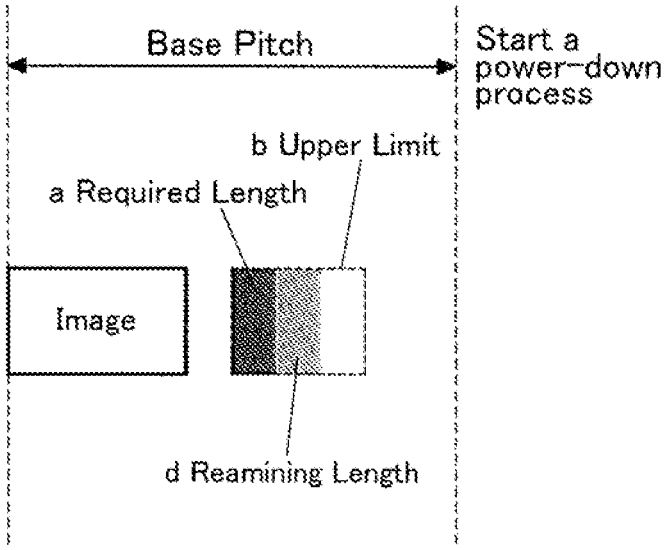
FIG. 18 is a timing diagram for reference in describing how to determine an amount of toner for a toner patch when a toner image for the next print job will not be formed so soon.

When a toner image for the next print job will be formed soon, a toner patch of the sum of the required length a and the remaining length d is formed after the last toner image, as illustrated in FIG. 18.

Figure 19:
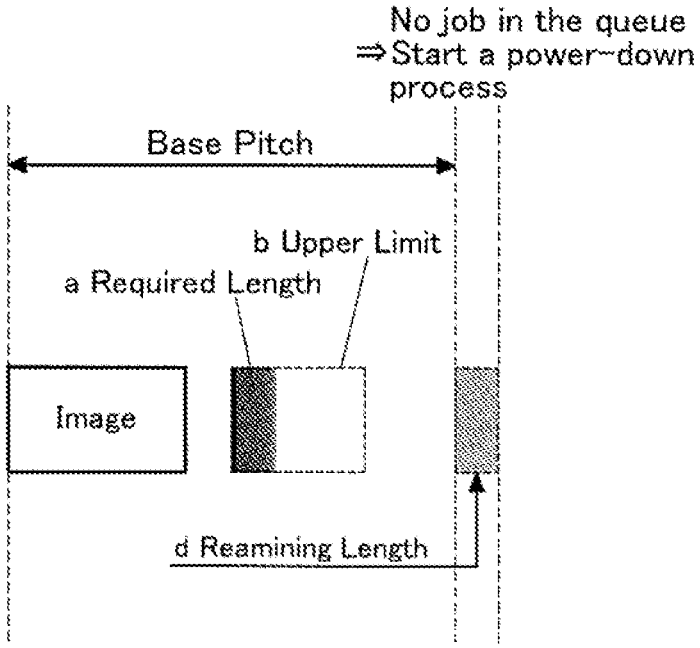
FIG. 19 is a timing diagram for reference in describing how to determine an amount of toner for a toner patch when a toner image for the next print job will be formed soon.

When a toner image for the next print job will not be formed so soon, a toner patch of the required length a is formed after the last toner image as normal, and a toner patch of the remaining length d is formed when the power-down process starts, as illustrated in FIG. 19.

As described above, when the imaging device is going to start a power-down process and the remaining length stored on the memory is not zero, a toner patch of the remaining length is formed such that toner of the remaining amount is able to be supplied to the photoconductor blade 201.

[PPM Control]

PPM control is performed when the remaining length stored on the memory is greater than a certain threshold. As described above, PPM control refers to a modulation scheme that briefly decreases the productivity by a certain percentage. Assuming that the productivity during normal operation is 100 sheets of paper per minute, for example, the productivity during PPM operation can be 90 sheets of paper per minute. PPM control serves the purpose of extending every space between two successive sheets of paper such that it is able to afford a longer toner patch. So, PPM control allows the remaining length stored on the memory to run out slowly but steadily.

The threshold on the remaining length for judging whether to perform PPM control is a variable dependent on at least one of the environment, the cumulative circumferential distance of the photosensitive drum 13, toner color, and the toner coverage of the last printed page. It is preferred that PPM control be performed earlier when the photoconductor blade 201 already has little toner on itself or in an environment where FD noise easily can be caused.

FIG. 20 is a table, as an example, that determines a threshold on the remaining amount of toner for judging whether to perform PPM control, depending on the environment and the cumulative circumferential distance of the photosensitive drum 13. In the example of FIG. 20, the threshold becomes less with a greater environment step number and with a longer cumulative circumferential distance of the photosensitive drum 13. Alternatively, the threshold may be a constant, not dependent on the environment, the cumulative circumferential distance of the photosensitive drum 13, toner color, or the toner coverage of the last printed page.

The productivity during PPM operation is a variable dependent on the remaining amount of toner, which is preferred. To prevent FD noise, the productivity during PPM operation must be lower with the more remaining amount of toner.

FIG. 21 is a table, as an example, that determines productivity during PPM operation as a percentage depending on the remaining amount of toner. Alternatively, the productivity may be a constant, not dependent on the remaining amount of toner.

[Flowchart]

Figure 22:
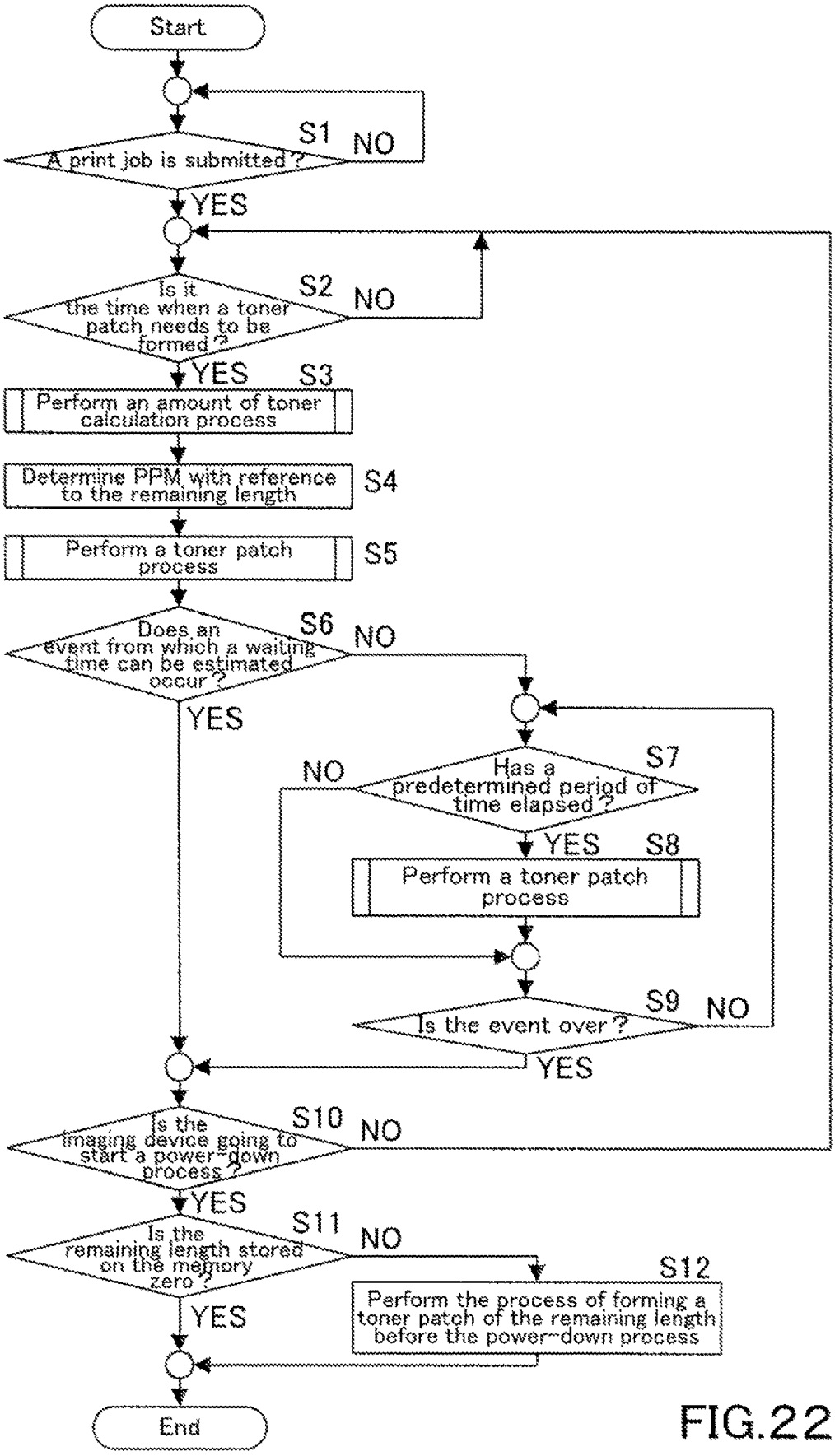
FIG. 22 is a flowchart representing a print job operation of the image forming apparatus, including forming toner patches on the photosensitive drum.

FIG. 22 is a flowchart representing a print job operation of the image forming apparatus 1, including forming toner patches TP on the photosensitive drum 13.

In Step S1, it is judged whether or not a print job is submitted. If a print job is not submitted (NO in Step S1), the program waits in Step S1 until a print job is submitted.

If a print job is submitted (YES in Step S1), it is then judged in Step S2 whether or not it is the time when a toner patch needs to be formed. If it is not the time when a toner patch needs to be formed (NO in Step S2), the program waits until it is the time when a toner patch needs to be formed. If it is the time when a toner patch needs to be formed (YES in Step S2), an amount of toner calculation process is performed in Step S3. The amount of toner calculation process will be later described in detail.

In Step S4, PPM is determined with reference to the remaining length. In Step S5, a toner patch process is performed to form a toner patch. The toner patch process will be later described in detail.

In Step S6, it is judged whether or not an event from which a waiting time can be estimated occurs. If such an event occurs (YES in Step S6), the program proceeds to Step S10. If such an event does not occur (NO in Step S6), it is then judged in Step S7 whether or not a predetermined period of time has elapsed. If a predetermined period of time has elapsed (YES in Step S7), the toner patch process is performed in Step S8, then the program proceeds to Step S9. If a predetermined period of time has not yet elapsed (NO in Step S7), the program proceeds to Step S9.

In Step S9, it is judged whether or not the event is over. If it is not yet over (NO in Step S9), the program returns to Step S7. A toner patch is thus formed every predetermined period of time. Back to Step S9, if the event is over (YES in Step S9), the program proceeds to Step S10.

In Step S10, it is judged whether or not the imaging device is going to start a power-down process. If it is not going to start a power-down process (NO in Step S10), the program returns to Step S2. If it is going to start a power-down process (YES in Step S10), it is then judged in Step S11 whether or not the remaining length stored on the memory is zero. If the remaining length stored on the memory is not zero (NO in Step S11), the process of forming a toner patch of the remaining length is performed before the power-down process in Step S12, then the program terminates. If the remaining length stored on the memory is zero (YES in Step S11), the program then terminates.

Figure 23:
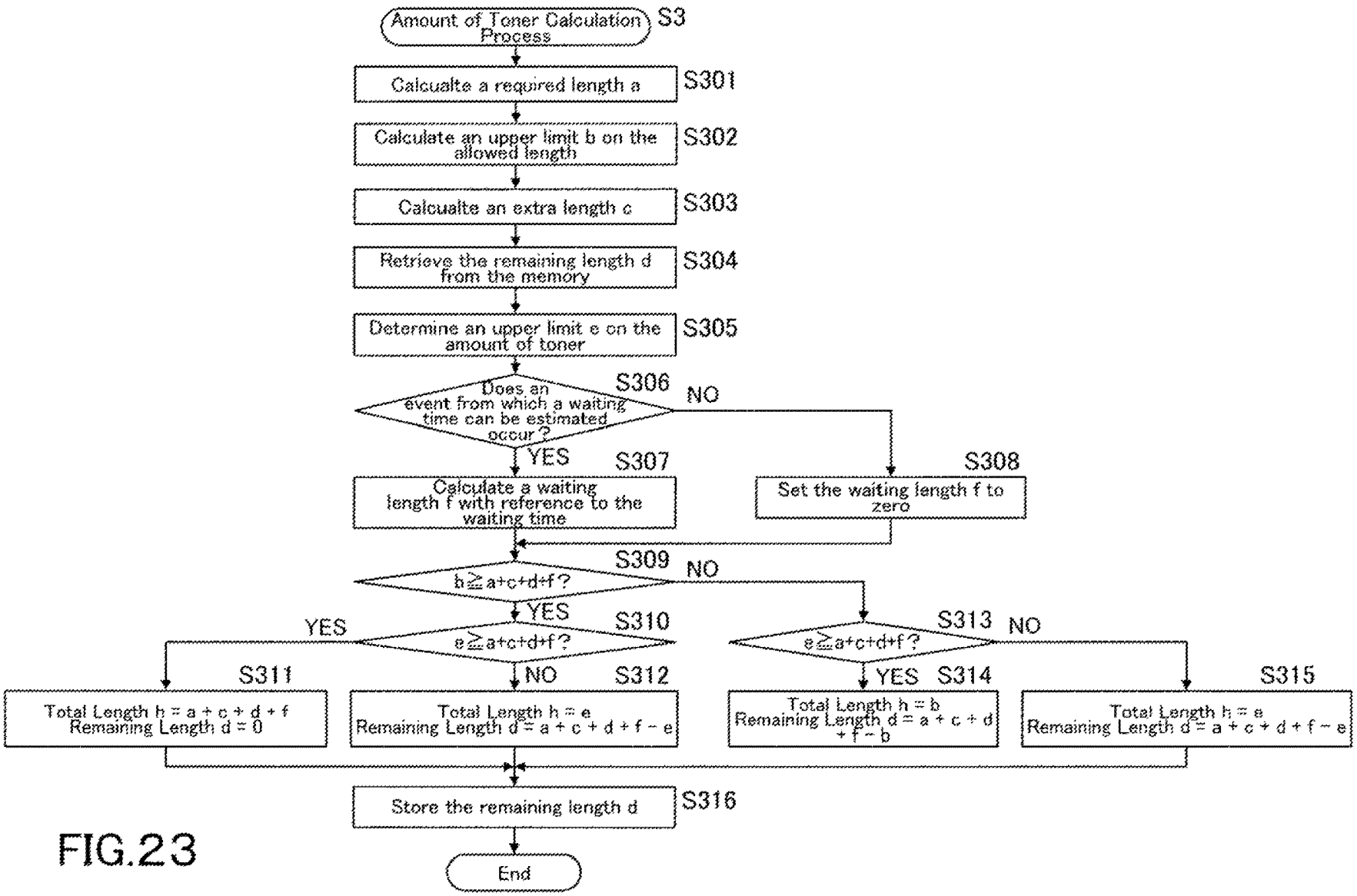
FIG. 23 is a flowchart representing an example of the amount of toner calculation process in Step S3 of FIG. 22.

FIG. 23 is a flowchart representing an example of the amount of toner calculation process in Step S3 of FIG. 22.

In Step S301, a required length a is calculated with reference to the base pitch from the present sheet of paper to the next sheet of paper. In Step S302, an upper limit b on the length of a toner patch is calculated with reference to the base pitch from the present sheet of paper to the next sheet of paper. In Step S303, an extra length c is calculated by subtracting the total length of the toner patch formed in the last pitch from the total length of a toner patch supposed to be needed in the last pitch.

In Step S304, the remaining length d is retrieved from the memory. In Step S305, an upper limit e (Lpmax) on the amount of toner, a value dependent on the cleaning performance of the photoconductor blade 201 is retrieved from the table.

In Step S306, it is judged whether or not an event from which a waiting time can be estimated occurs. If such an event occurs (YES in Step S306), a waiting length f is calculated with reference to the waiting time in Step S307, then the program proceeds to Step S309. If such an event does not occur (NO in Step S306), the waiting length f is set to zero in Step S308, then the program proceeds to Step S309.

In Step S309, it is judged whether or not b≥a+c+d+f. If b≥a+c+d+f (YES in Step S309), it is then judged in Step S310 whether or not ea+c+d+f. If e≥a+c+d+f (YES in Step S310), the total length of a toner patch is set to a value obtained from a+c+d+f, and the remaining length d is set to zero, in Step S311. The program then proceeds to Step S316. If not e≥a+c+d+f (NO in Step S310), the total length of a toner patch is set to the same value as the upper limit e and the remaining length d is set to a value obtained from a+c+d+f−e, in Step S312. The program then proceeds to Step S316.

Back to Step S309, if not b≥a+c+d+f (NO in Step S309), it is then judged in Step S313 whether or not e≥a+c+d+f. If e≥a+c+d+f (YES in Step S313), the total length of a toner patch is set to the same value as the upper limit b and the remaining length d is set to a value obtained from a+c+d+f−b, in Step S314. The program then proceeds to Step S316. If not e≥a+c+d+f (NO in Step S313), the total length of a toner patch is set to the same value as the upper limit e and the remaining length d is set to a value obtained from a+c+d+f−e, in Step S315. The program then proceeds to Step S316.

The remaining length d is stored on the memory in Step S316. The program then terminates the amount of toner calculation process.

Figure 24:
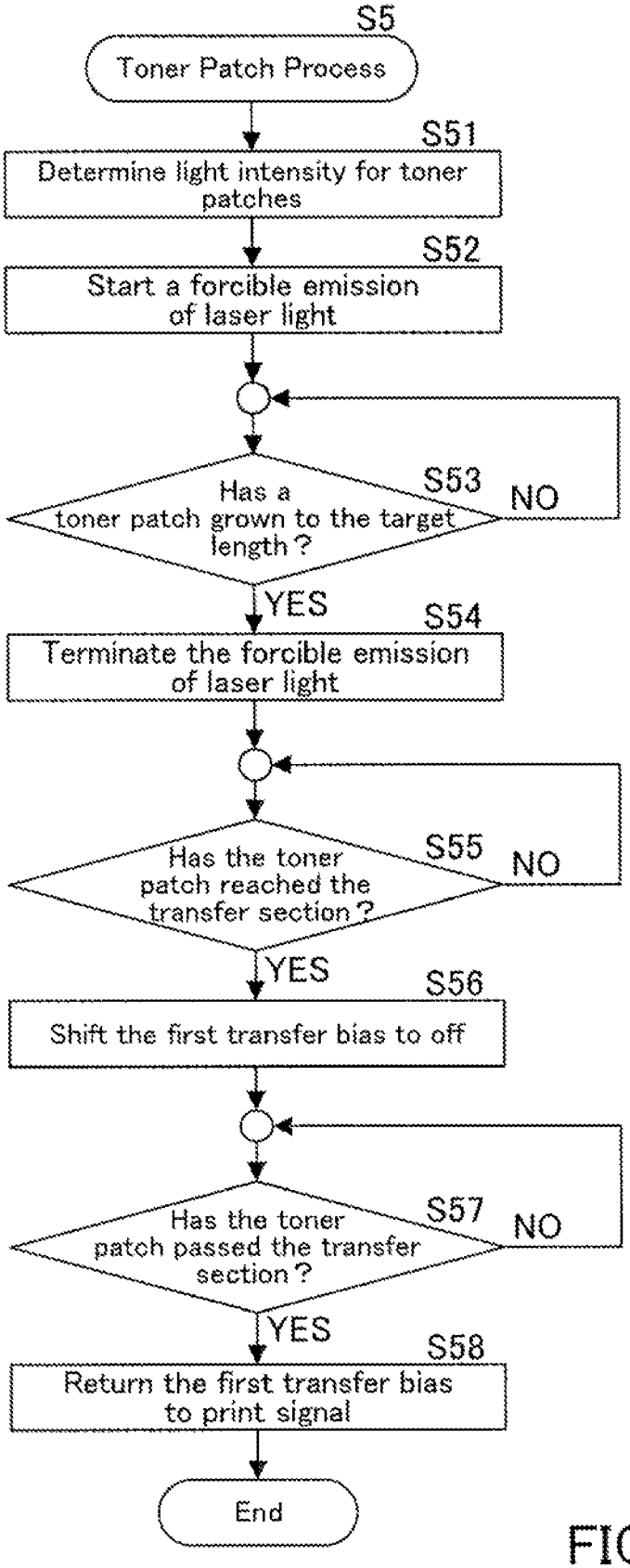
FIG. 24 is a flowchart representing an example of the toner patch process in Steps S5 and S8 of FIG. 22.

FIG. 24 is a flowchart representing an example of the toner patch process in Steps S5 and S8 of FIG. 22. In this example, toner patches TP are formed with laser light.

In Step S51, light intensity for toner patches is determined. In Step S52, a forcible emission of laser light is started. In Step S53, it is judged whether or not a toner patch has grown to the target length. If it has not yet grown to the target length (NO in Step S53), the program waits until it grows to the target length. If a toner patch has grown to the target length (YES in Step S53), the forcible emission of laser light is terminated in Step S54.

In Step S55, it is judged whether or not the toner patch has reached the transfer section 213. If it has not yet reached (NO in Step S55), the program waits until it reaches the transfer section 213. If it has reached (YES in Step S55), the first transfer bias is shifted from print signal to off in Step S56.

In Step S57, it is judged whether or not the toner patch has passed the transfer section 123. If it has not yet passed (NO in Step S57), the program waits until it passes the transfer section 123. If it has passed (YES in Step S57), the first transfer bias is returned from patch signal to print signal in Step S58.

Figure 25:
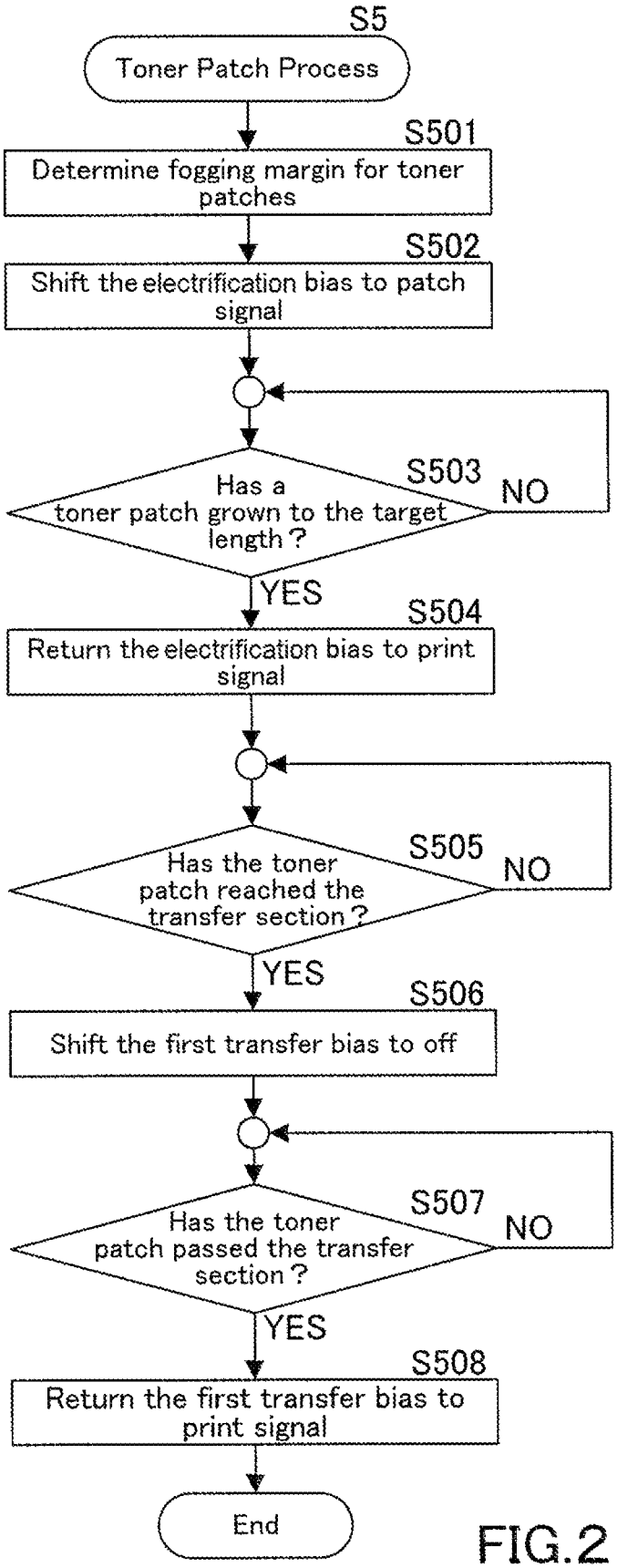
FIG. 25 is a flowchart representing another example of the toner patch process in Steps S5 and S8 of FIG. 22.

FIG. 25 is a flowchart representing another example of the toner patch process in Steps S5 and S8 of FIG. 22. In this example, toner patches are formed by shifting the electrification bias.

In Step S501, fogging margin for toner patches is determined. In Step S502, the electrification bias is shifted from print signal to patch signal. In Step S503, it is judged whether or not a toner patch has grown to the target length. If it has not yet grown to the target length (NO in Step S503), the program waits until it grows to the target length. If a toner patch has grown to the target length (YES in Step S503), the electrification bias is returned from patch signal to print signal in Step S504.

In Step S505, it is judged whether or not the toner patch has reached the transfer section 213. If it has not yet reached (NO in Step S505), the program waits until it reaches the transfer section 213. If it has reached (YES in Step S505), the first transfer bias is shifted from print signal to off in Step S506.

In Step S507, it is judged whether or not the toner patch has passed the transfer section 123. If it has not yet passed (NO in Step S507), the program waits until it passes the transfer section 123. If it has passed (YES in Step S507), the first transfer bias is returned from patch signal to print signal in Step S508.

Figure 26:
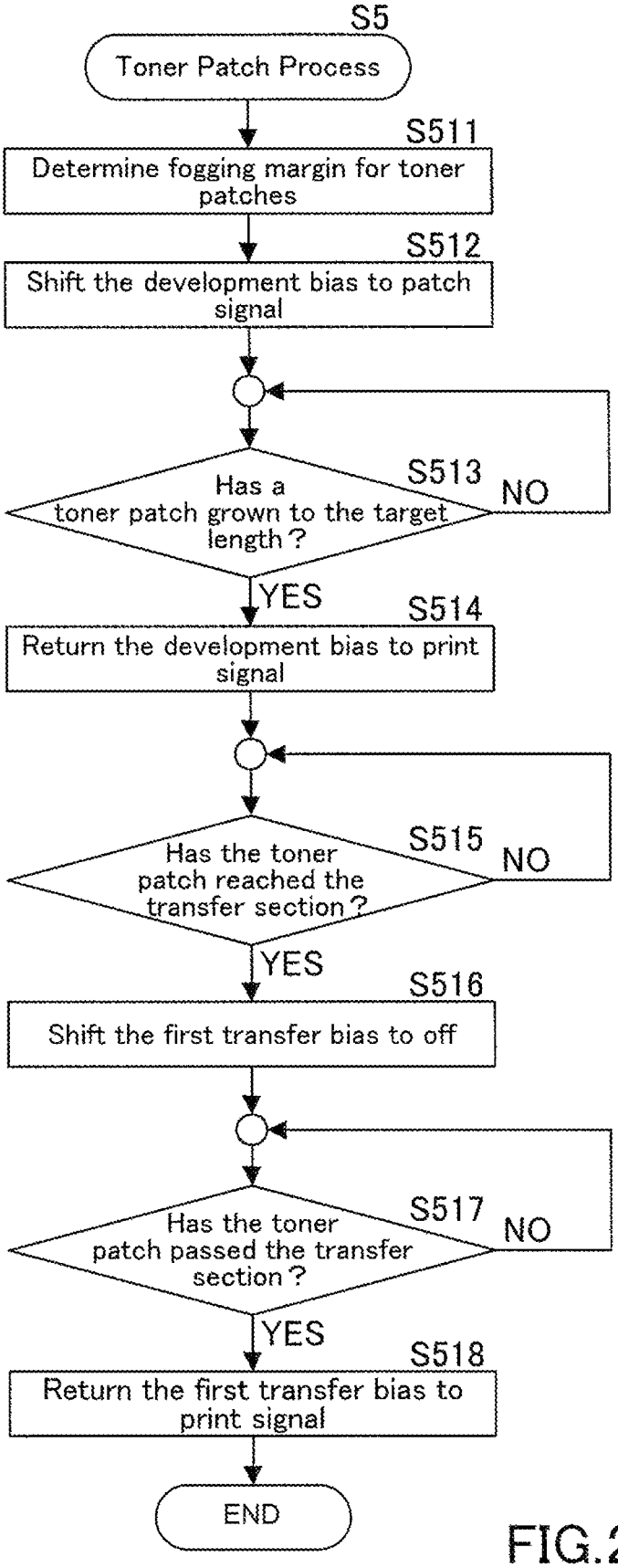
FIG. 26 is a flowchart representing yet another example of the toner patch process in Steps S5 and S8 of FIG. 22.

FIG. 26 is a flowchart representing yet another example of the toner patch process in Steps S5 and S8 of FIG. 22. In this example, toner patches are formed by shifting the development bias.

In Step S511, fogging margin for toner patches is determined. In Step S512, the development bias is shifted from print signal to patch signal. In Step S513, it is judged whether or not a toner patch has grown to the target length. If it has not yet grown to the target length (NO in Step S513), the program waits until it grows to the target length. If a toner patch has grown to the target length (YES in Step S513), the development bias is returned from patch signal to print signal in Step S514.

In Step S515, it is judged whether or not the toner patch has reached the transfer section 213. If it has not yet reached (NO in Step S505), the program waits until it reaches the transfer section 213. If it has reached (YES in Step S515), the first transfer bias is shifted from print signal to off in Step S516.

In Step S517, it is judged whether or not the toner patch has passed the transfer section 123. If it has not yet passed (NO in Step S517), the program waits until it passes the transfer section 123. If it has passed (YES in Step S517), the first transfer bias is returned from patch signal to print signal in Step S518.

Although one or more embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a photoconductor;

a transfer portion;

a photoconductor cleaner that removes residual toner from a surface of the photoconductor; and a first processor that forms a toner patch on the surface of the photoconductor, wherein, when the toner patch passes the transfer portion, the transfer portion makes the toner patch stay on the surface of the photoconductor such that toner of the toner patch is able to be supplied to the photoconductor cleaner, the first processor further determining an amount of toner for the toner patch with reference to a circumferential distance the photoconductor travels for a predetermined period of time.

2. The image forming apparatus according to claim 1, wherein the circumferential distance the photoconductor travels for the predetermined period of time is a circumferential distance the photoconductor travels from a base point for an (n−1)-th sheet of paper to the base point for an n-th sheet of paper.

3. The image forming system according to claim 2, wherein, the base point for each sheet of paper is a leading-edge point for the each sheet of paper, a trailing-edge point for the each sheet of paper, a leading edge of the toner patch, or a trailing edge of the toner patch.

4. The image forming apparatus according to claim 1, further comprising a second processor that determines a base pitch from the n-th sheet of paper to an (n+1)-th sheet of paper with reference to a print setting, wherein the circumferential distance the photoconductor travels for the predetermined period of time is calculated with reference to the base pitch determined by the second processor and an estimated circumferential distance the photoconductor travels from the base point for the n-th sheet of paper to the base point for the (n+1)-th sheet of paper.

5. The image forming apparatus according to claim 1, wherein the first processor corrects the amount of toner, with reference to a distance from an (n−1)-th sheet of paper to an n-th sheet of paper, the amount of toner being determined with reference to the circumferential distance the photoconductor travels for the predetermined period of time, the circumferential distance being the distance from the n-th sheet of paper to an (n+1)-th sheet of paper.

6. The image forming apparatus according to claim 5, wherein the first processor corrects the amount of toner by adding an extra amount of toner to the amount of toner, the extra amount of toner being an amount of toner lacking in space between the (n−1)-th and n-th sheet of paper, the amount of toner being determined with reference to the distance from the (n−1)-th sheet of paper to the n-th sheet of paper.

7. The image forming apparatus according to claim 1, storing a default amount of toner, the default amount of toner being dependent on a default distance, wherein the first processor determines the amount of toner by multiplying the default amount of toner by a coefficient, the coefficient being calculated with reference to the circumferential distance and the default distance.

8. The image forming apparatus according to claim 7, wherein the default amount of toner is dependent on at least one of an environment, a cumulative circumferential distance of the photoconductor, and toner color.

9. The image forming apparatus according to claim 1, wherein the first processor determines the amount of toner for the toner patch by determining either or both of a length of the toner patch and a toner density of the toner patch.

10. The image forming apparatus according to claim 1, further comprising a memory that stores a remaining amount of toner when a toner patch of the amount of toner determined by the first processor is not afforded by space between an n-th and (n+1)-th sheet of paper, the remaining amount of toner being carried over from the space between the n-th and (n+1)-th sheet of paper.

11. The image forming apparatus according to claim 10, wherein a toner patch of the amount of toner determined by the first processor is not afforded by the space between the n-th and (n+1)-th sheet of paper when a length determined by the first processor is longer than an upper limit on an allowed length, the upper limit being dependent on at least one of: a distance from the n-th sheet of paper to the (n+1)-th sheet of paper, a speed of the photoconductor, a response time of the transfer portion, and a response time of the first processor.

12. The image forming apparatus according to claim 10, wherein a toner patch of the amount of toner determined by the first processor is not afforded by the space between the n-th and (n+1)-th sheet of paper when the amount of toner determined by the first processor is greater than an upper limit on an amount of toner for one toner patch, the upper limit being dependent on a cleaning performance of a photoconductor blade of the photoconductor cleaner.

13. The image forming apparatus according to claim 10, wherein the first processor corrects the amount of toner by adding the remaining amount of toner to the amount of toner.

14. The image forming apparatus according to claim 10, wherein, when an event that extends the space between the n-th and the (n+1)-th sheet of paper occurs after the first processor determines the amount of toner, the first processor corrects the amount of toner depending on what the event is.

15. The image forming apparatus according to claim 14, wherein, when a waiting time can be estimated from the event, the first processor corrects the amount of toner by adding an extra amount of toner to the amount of toner, the extra amount of toner corresponding to an extra circumferential distance the photoconductor needs to travel because of the waiting time.

16. The image forming apparatus according to claim 10, wherein, when an imaging portion is going to start a power-down process and the remaining amount of toner stored in the memory is not zero, the first processor forms the toner patch from toner of the remaining amount of toner on the surface of the photoconductor after the last toner image.

17. The image forming apparatus according to claim 10, wherein, when the remaining amount of toner is greater than an upper limit on an amount of toner for one toner patch, the upper limit being dependent on a cleaning performance of a photoconductor blade of the photoconductor cleaner, the first processor forms the toner patch from the upper limit on the amount of toner on the surface of the photoconductor, and the memory stores an excess portion from the upper limit as the remaining amount of toner.

18. The image forming apparatus according to claim 17, wherein, when the remaining amount of toner carried over from the space between an (n−1)-th and n-th sheet of paper is greater than a certain threshold, the space between the n-th and (n+1)-th sheet of paper is extended more than normal space.

19. The image forming apparatus according to claim 10, wherein, when printing is interrupted while the first processor forms the toner patch from the amount of toner determined by the first processor, the remaining amount of toner is increased by a portion missing from the amount of toner determined by the first processor.

20. The image forming apparatus according to claim 19, wherein the memory storing the remaining amount of toner is a non-volatile memory.

21. The image forming apparatus according to claim 1, further comprising a laser that emits laser light to form a toner image on the photoconductor, wherein the first processor forms the toner patch by making the laser emit laser light.

22. The image forming apparatus according to claim 1, wherein, when the toner patch formed by the first processor passes the transfer portion, the toner patch is kept on the surface of the photoconductor by shifting voltage applied to the transfer portion to patch signal, patch signal allowing the toner patch to escape from being transferred.

23. The image forming apparatus according to claim 1, wherein the first processor forms the toner image between two successive toner images or in a non-toner-image region following the last toner image.

24. A toner supply method for an image forming apparatus comprising:

a photoconductor;

a transfer portion; and a photoconductor cleaner that removes residual toner from a surface of the photoconductor, and the toner supply method allowing the image forming apparatus to supply toner to the photoconductor cleaner, the toner supply method comprising:

determining an amount of toner with reference to a circumferential distance the photoconductor travels for a predetermined period of time;

forming a toner patch of the determined amount of toner on the surface of the photoconductor; and when the toner patch passes the transfer portion, making the toner patch stay on the surface of the photoconductor such that toner of the determined amount is able to be supplied to the photoconductor cleaner.

* * * * *